US007846626B2

(12) United States Patent
Itami et al.

(10) Patent No.: US 7,846,626 B2
(45) **Date of Patent: *Dec. 7, 2010**

(54) IMAGE FORMING METHOD AND IMAGE FORMING APPARATUS

(75) Inventors: Akihiko Itami, Hachioji (JP); Masao Asano, Tokyo (JP); Hiroshi Yamazaki, Hachioji (JP); Kunio Shigeta, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1063 days.

This patent is subject to a terminal disclaimer.

(21) Appl. No.: 11/259,219

(22) Filed: Oct. 26, 2005

(65) Prior Publication Data

US 2006/0110675 A1 May 25, 2006

(30) Foreign Application Priority Data

Nov. 25, 2004 (JP) ..... 2004-340191

(51) Int. Cl.
*G03G 13/01* (2006.01)
*G03G 13/09* (2006.01)

(52) U.S. Cl. ..... 430/45.32; 430/45.55; 430/46.1; 430/47.2; 430/122.1; 430/122.7; 420/122.8

(58) Field of Classification Search ..... 430/45.32, 430/45.3, 45.55, 46.1, 47.2, 122.7, 122.8, 430/122.1; 399/267
See application file for complete search history.

(56) References Cited

U.S. PATENT DOCUMENTS

| | | | | |
|---|---|---|---|---|
| 5,659,861 | A * | 8/1997 | Yamashita et al. | 399/267 |
| 6,124,067 | A * | 9/2000 | Mikuriya et al. | 430/100 |
| 6,472,113 | B2 * | 10/2002 | Hamaguchi et al. | 430/65 |
| 6,689,522 | B2 * | 2/2004 | Yamazaki et al. | 430/45.1 |
| 7,459,256 | B2 * | 12/2008 | Itami et al. | 430/122.2 |
| 7,473,509 | B2 * | 1/2009 | Itami et al. | 430/123.42 |
| 7,477,866 | B2 * | 1/2009 | Itami et al. | 399/267 |
| 2001/0019674 | A1 * | 9/2001 | Asano et al. | 399/223 |
| 2003/0147670 | A1 | 8/2003 | Asano et al. | |
| 2003/0157421 | A1 | 8/2003 | Matsushima et al. | |
| 2004/0072092 | A1 * | 4/2004 | Matsushima et al. | 430/109.1 |

FOREIGN PATENT DOCUMENTS

| | | |
|---|---|---|
| JP | 2002244336 | 8/2002 |

* cited by examiner

*Primary Examiner*—Janis L Dote
(74) *Attorney, Agent, or Firm*—Lucas & Mercanti, LLP

(57) ABSTRACT

A toner image is formed while a developing sleeve is rotated in a direction counter to that of an organic photoreceptor at the developing section and a developing agent contains toner which contains toner particles having a particle diameter of 0.7×(Dp50) or less in an amount of 8 number % or less and has water content of 0.1 to 2.0 mass % under an environment of 30° C. and 80% RH, where Dp50 represents 50% number % particle diameter of toner particles.

10 Claims, 3 Drawing Sheets

IMAGE FORMING METHOD AND IMAGE FORMING APPARATUS

BACKGROUND OF THE INVENTION

The present invention relates to an image forming method for the image formation of the electronic photographing method, an image forming apparatus and an organic photosensitive body, and in more detail, to an image forming method for the image formation of the electronic photographing system used in a field of a copier or a printer, an image forming apparatus and an organic photosensitive body (hereinafter, simply called organic photoreceptor).

The main subject of an organic photoreceptor is transferred from an inorganic photoreceptor such as Se, arsenic, arsenic/Se alloy, CdS, ZnO, to an organic photoreceptor which has an advantages in the environmental pollution, or easiness of manufacturing, and the organic photoreceptor using various materials are developed.

Recently, the function separation type organic photoreceptor in which functions for generating the charge and for charge transportation are made in charge to different materials, becomes the main stream, for example, a laminated type organic photoreceptor in which the charge generating layer, charge transporting layer are laminated through the intermediate layer on the conductive supporting body, is widely used (Patent Document 1).

Further, when looks at the electronic photographic process, in the latent image formation system, it is largely separated into an analog image formation using the halogen lamp as a light source and a digital system image formation using LED or laser as a light source. Recently, as a printer for hard-copy of the personal computer, further, also in the normal copier, from the easiness of the image processing or the easiness of the development to the composite machine, the digital system latent image formation system is rapidly becoming the main stream.

Further, in the digital system image formation method, the opportunity for making the print image of the original is increased, and the requirement for the high quality image is increased. For the high quality image-making of the electronic photographing image, a technology by which the minute latent image formation is conducted by using the light source for exposure whose spot diameter is small, on the organic photoreceptor, and the minute dot image is formed, is developed. For example, by using the light source whose spot diameter is less than 4000 $\mu m^2$, a method by which the high accurate latent image is formed on the organic photoreceptor is well known (Patent Document 2). Even when the high density dot exposure is conducted by such a small diameter spot, the organic photoreceptor by which the high density and uniform latent image can be formed by the dot exposure, and the structure of the developing mode by which the latent image can be reproduced as a toner image, are not yet attained sufficiently. Further, in a dot image, there are problems that a transverse line image becomes thin (a phenomenon in which a one dot line image formed in a direction perpendicular to a paper conveying direction becomes thin in comparison with one dot line image formed in the paper conveying direction), and a trailing edge becomes white omission (a phenomenon in which the image density of a trailing edge portion of a halftone picture image in the paper conveying direction is lowered than the leading edge portion or the trailing edge portion is not developed).

That is, as the developing method of the latent image on the organic photoreceptor, a developing mode by which the developing sleeve oppositely provided to the organic photoreceptor is advanced in parallel with the advancing direction of the organic photoreceptor in the developing area (hereinafter, parallel developing mode), and a developing mode by which the developing sleeve is advanced in the counter direction (hereinafter, counter developing mode) are well known, however, for both, when the high density dot image is formed, the problems can not be solved sufficiently.

In the parallel developing mode by which the developing sleeve oppositely provided to the organic photoreceptor is advanced in parallel with the advancing direction of the organic photoreceptor, the developing property of the periphery of the high density image is deteriorated, and is easily brought to the insufficient density, and in the photographic image whose contrast is high, the image quality is easily deteriorated.

On the one hand, in the counter developing mode by which the developing sleeve is advanced in the counter direction, the developing property is high, and the high density dot image can be formed, however, the fog is often generated, and the insufficient density is easily generated in the leading edge part.

Further, recently, a fine unevenness trouble so called a worm-like unevenness becomes a problem. Although the cause of this worm-like unevenness has not clarified sufficiently, it may be considered that when a relative velocity between a organic photoreceptor and a developing sleeve becomes faster and a triboelectric charging between a magnetic brush of a developer and a organic photoreceptor becomes stronger, the worm-like unevenness may occur. For this reason, in comparison with the parallel developing mode, the worm-like unevenness tends to occur in the counter developing mode. Further, the worm-like unevenness has a relative relationship with a frequency of the developing bias such that if the frequency becomes higher, the worm-like unevenness becomes fewer. However, when the frequency becomes higher, there is a tendency that the sharpness of an image becomes lowered. That is, it may be difficult to satisfy both of the reduction of the worm-like unevenness and the sharpness of an image.

The phenomena as described above, are not solved enough simply by only the improvement of the developer, but it is found that also by the characteristic of the organic photoreceptor, these phenomena are deteriorated or improved.

That is, it is presumed that these phenomena relate to the contrast of the electro-static latent image formed on the organic photoreceptor, or also to the generation of the inverse charge toner by the rubbing of the organic photoreceptor and the developer.

Even when the electrostatic image is formed with a high resolution, in the counter development method, if the toner charge distribution is broad, it is easy for the generation of toner with reverse charging characteristics, and as a result, it is easy for toner splashing or reduction of edge section density to occur, and it is not possible to reproduce an electrostatic latent image with a high resolution as a toner image. Conventionally, it has been proposed (see Patent Document 3) to use in the developing means polymerization toners whose granularity distribution has been made narrow. However, with the toner having the granularity distribution proposed in that disclosure, in the case of the counter development method, it has been discovered that it is not possible to suppress sufficiently the generation of toner splashing and that it is not possible to reproduce a high resolution electrostatic latent image as a toner image. Further, recently, a fine unevenness trouble so called a worm-like unevenness becomes a problem. Although the cause of this worm-like unevenness has not clarified sufficiently, it may be considered that when a relative velocity between a organic photoreceptor and a developing sleeve becomes faster and a triboelectric charging between a magnetic brush of a developer and a organic photoreceptor becomes stronger, the worm-like unevenness may occur. For this reason, in comparison with the parallel developing mode, the worm-like-unevenness tends to occur in the counter developing mode. Further, the worm-like unevenness has a relative relationship with a frequency of the developing bias such that if the frequency becomes higher, the worm-like unevenness becomes fewer. However, when the frequency becomes higher, there is a tendency that the sharpness of an image becomes lowered. That is, it may be difficult to satisfy both of the reduction of the worm-like unevenness and the sharpness of an image.

[Patent Document 1] Tokkai No. 2004-133018

[Patent Document 2] Tokkaihei No. 8-272197

[Patent Document 3] Tokkaihei No. 2002-244336

SUMMARY OF THE INVENTION

The present invention is related to an image forming method capable of forming high resolution digital images in a stable manner while solving the above types of problems in the conventional technology, that is, while solving the problem that occurs in the counter development method, and, in more detail, the purpose of the present invention is to provide an image forming method and an image forming apparatus that can prepare electro-photographic images with high image densities and with good color reproduction while preventing fog that can occur easily in the counter development method and the occurrence of image striations due to reduction in the edge section densities.

In order to achieve the above objectives of the present invention, that is, obtaining uniform and high resolution electro-photographic images while solving the problems of fog that can occur easily in the counter development method and the occurrence of partial density insufficiencies, as a result of investigating the relationship between the composition of the developing agent, composition of the organic photoreceptor, and the development method, in order to prevent fog that can occur easily in the counter development method, the occurrence of image striations due to reduction in the edge section densities and a worm-like unevenness, we completed the present invention after finding out that it is effective to make smaller the fine toner constituents of toners used as the developing agent and to make small the water content of the toner. Namely, by making a counter developing mode proper, the problems of the generation of uneven image based on the fog and the leading edge part density lowering can be improved. However, it has not been attained to satisfy both requirements of the prevention of the unevenness trouble so called a worm-like unevenness and the enhancement of the sharpness. As a result of the study by the inventor, by using a organic photoreceptor having an intermediate layer according to the invention in the counter developing mode, it has been learned that the above both requirements can be attained, in addition, the problems of the occurrence of fog and the density shortage at the image leading portion can be improved. Although the reason why the both requirements of the prevention of the unevenness trouble so called a worm-like unevenness and the enhancement of the sharpness can be attained is not clear, it is presumed that a blocking function with reference to the size of inorganic particles in the intermediate layer according to the invention causes the same effect by increasing the frequency of the developing bias.

DETAILED DESCRIPTION OF THE PREFERRED EMBODIMENT

Figure 1:
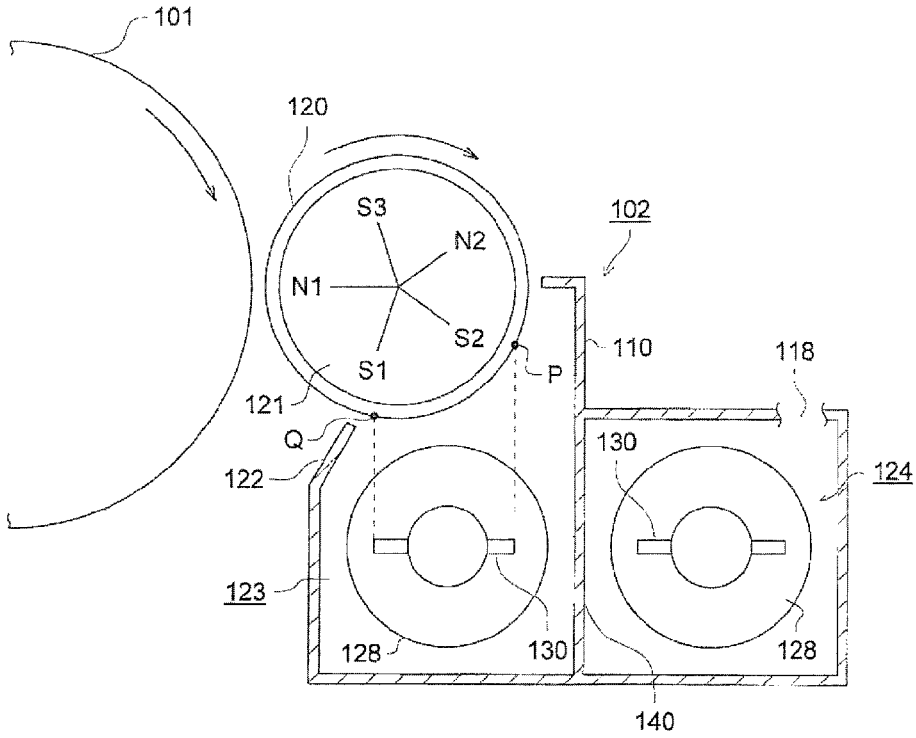
FIG. 1 is a view showing a cross section of a developing device of a counter direction developing method.

The present invention is described in detail below.

The image forming method according to the present invention has the feature that, in an image forming method of forming an electrostatic latent image on an organic photoreceptor, making a developing sleeve carrying the developing agent including the toner come into contact with the organic photoreceptor and converting that latent electrostatic image into a visible toner image, if the 50% number particle diameter of toner particles (it may be called also median diameter in number distribution) is represented by Dp50, the developing agent includes a toner with a content of 8 number % of toner particles with a particle diameter of 0.7×(Dp50) or less and with water content of 0.1-2.0 mass % (30° C., 80% RH), and the development sleeve is rotated in a counter direction related to the direction of rotation of the organic photoreceptor and is made to come in contact with it, thereby converting the latent electrostatic image into a visible toner image.

Further, in the image forming method according to the present invention, in an image forming method of forming color images by placing a plural number of image forming units having a developing means that forms electrostatic latent images on an organic photoreceptor and that makes a developing sleeve carrying the developing agent including the toner come into contact with the organic photoreceptor thereby converting the latent electrostatic image into a visible toner image, and a transfer means that transfers the toner image formed on an organic photoreceptor on to a transfer medium, forming toner images of different colors on the organic photoreceptors using toners of different colors in each of the plural number of image forming units, and transferring the images of different colors from the organic photoreceptors to the transfer medium, with the feature that, if the 50% number particle diameter of toner particles (it may be called also median diameter in number distribution) is represented by Dp50, each of the developing agents includes a toner with a content of 8% by number of toner particles with a particle diameter of 0.7×(Dp50) or less and with water content of 0.1-2.0 mass % (30° C., 80% RH), and the development sleeve is rotated in a counter direction related to the direction of rotation of the organic photoreceptor and is made to come in contact with it, thereby converting the latent electrostatic image into a visible toner image.

By having the above configuration, the image forming method according to the present invention can provide high quality digital images or color images while preventing fog and edge section density insufficiencies that can occur easily in the counter development method.

The developing-agent includes a toner with a content of 8 number % of toner particles with a particle diameter of 0.7×(Dp50) or less.

When the content of toner particles with a particle diameter of 0.7×(Dp50) or less exceeds 8 number %, the presence ratio of fine diameter components increases thereby causing increase in weakly charged toner particles, generation of opposite polarity toner particles, or the generation of excessively charged toner particles, etc. As a result, in the counter development method, it is easy for fog or edge section density reductions to occur and the color reproducibility of color images is likely to get deteriorated.

Further, the water content of toner is strongly related to the charging characteristics and charge retention characteristics of the toner. In the present invention, with a toner having the above distribution characteristics, it was found out that the rate of rise of charging and the charge retention characteristics of the toner are good when the water content is in the range of 0.1-2.0 mass %. At water content of less than 0.1 mass %, the rate of rise of charging decreases, generation of weakly charged toner becomes likely, and it is easy for fog or edge section density reductions to occur in the counter development method. On the other hand, when the water content exceeds 2.0 mass %, the charge retention characteristics of the toner gets reduced, the image density is likely to become lower, and it becomes easy for edge section density reductions to occur.

In addition, concerning the particle size distribution of the toner, it is desirable that the ratio (Dv50/Dp50) of 50% volume particle diameter (Dv50) to 50% number particle diameter (Dp50) is in the range of 1.0-1.11, and more preferably in the range of 1.0-1.10.

Further, it is desirable that the ratio (Dv75/Dp75) of cumulative 75% volume particle diameter (Dv75) from the largest toner particles to 75% particle count particle diameter (Dp75) is in the range of 1.0-1.10. If this ratio exceeds 1.10, the presence ratio of fine particle diameter component tends to increase thereby causing increase in weakly charged toner particles, generation of opposite polarity toner particles, or the generation of excessively charged toner particles, etc. As a result, in the counter development method, it is easy for fog or edge section density reductions to occur and the color reproducibility of color images is likely to get deteriorated.

Further, it is desirable that the 50% volume particle diameter (Dv50) is in the range of 2-9 μm, and more desirably in the range of 3-7 μm. It is possible to make the resolution high by selecting this range. In addition, by combining with the above range, it is possible to reduce the presence quantity of fine particle diameter toners, while being a small particle diameter toner, the reproducibility of dot images gets improved over the long term, and hence it is possible to form stable images with good sharpness.

By using the image forming method and an image forming apparatus according to the present invention, it is possible to provide electro-photographic images with good color reproducibility while preventing fog and edge section density insufficiencies that can occur easily in the counter development method.

In the present invention, the cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

In the present invention, particle size distribution, 50 percent volume particle diameter (Dv50), 50 percent number particle diameter (Dp50), cumulative 75 percent volume particle diameter (Dv75), and cumulative 75 percent number particle diameter (Dp75) can be measured by Sheath-flow electric resistance formula particle size analyzer SD-2000).

In the technical field in which electrostatic latent images are visualized employing dry system development, as an electrostatic image developing toner employed are those which are prepared by adding external additives to colored particles containing at least colorants and resins. However, as long as specifically there occurs no problems, it is generally described that colored particles are not differentiated from the electrostatic latent image developing toner. The particle diameter and particle size distribution of the colored particles result in the same measurement values as the electrostatic latent image developing toner.

The particle diameter of external agents is in an order of nm in terms of the number average primary particle diameter. It is possible to determine the diameter employing an Electrophoretic Light Scattering Spectrophotometer "ELS-800" (manufactured by Otsuka Electronics Co., Ltd.).

The structure as well as the production method of the toner will now be described.

<Toner>

Toner which may be prepared by pulverization method or polymerization method can be employed. Polymerization toner is preferably employed because toner having uniform particle size distribution is stably obtained.

The polymerization toner is prepared by polymerization of binder resin of toner from monomers, and if necessary, subsequent chemical process. Practically it includes polymerization process such as suspension polymerization and emulsion polymerization, and fusion process of particles conducted thereafter if necessary.

It is preferable that a coalesced type toner is employed, which is prepared by salting out and fusing resin particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resin particles and colorant particles) at temperatures higher than or equal to the glass transition temperature (Tg) of resins constituting the resin particles.

Releasing Agent

The preferable releasing agent is exemplified.

$$R^1—(OCO—R^2)_n$$

In the formula n is an integer from 1 to 4, preferably from 2 to 4, and more preferably 3 or 4. $R^1$ and $R^2$ each represents a hydrocarbon group, which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula n is an integer from 1 to 4, preferably from 2 to 4, more preferably 3 or 4 and particularly 4.

The compound is synthesized by a dehydration condensation reaction of an alcohol compound and a carbonic acid adequately.

Most preferable example of the compound is pentaerythritoltetrabehanate.

Representative examples are listed as compounds 1 to 26.

1) $CH_3-(CH_2)_{12}-COO-(CH_2)_{17}-CH_3$

2) $CH_3-(CH_2)_{18}-COO-(CH_2)_{17}-CH_3$

3) $CH_3-(CH_2)_{20}-COO-(CH_2)_{21}-CH_3$

4) $CH_3-(CH_2)_{14}-COO-(CH_2)_{19}-CH_3$

5)

$CH_3-(CH_2)_{20}-COO-(CH_2)_6-O-CO-(CH_2)_{20}-CH_3$

6)

$CH_3-(CH_2)_{20}-COO-(CH_2)_2-CH(CH_3)-CH_2-O-CO-(CH_2)_{20}-CH_3$

7)

$CH_3-(CH_2)_{22}-COO-(CH_2)_2-CH(CH_3)-CH_2-O-CO-(CH_2)_{22}-CH_3$

8)

$CH_3-(CH_2)_{22}-COO-CH_2-C(CH_3)_2-CH_2-O-CO-(CH_2)_{22}-CH_3$

9)

$CH_3-(CH_2)_{26}-COO-CH_2-C(CH_3)_2-CH_2-O-CO-(CH_2)_{26}-CH_3$

10) $CH_2-O-CO-(CH_2)_{26}-CH_3$
$CH-O-CO-(CH_2)_{26}-CH_3$
$CH_2-O-CO-(CH_2)_{26}-CH_3$

11) $CH_2-O-CO-(CH_2)_{22}-CH_3$
$CH-O-CO-(CH_2)_{22}-CH_3$
$CH_2-O-CO-(CH_2)_{22}-CH_3$

12) $CH_2-OH$
$CH-O-CO-(CH_2)_{26}-CH_3$
$CH_2-O-CO-(CH_2)_{26}-CH_3$

13) $CH_2-OH$
$CH-O-CO-(CH_2)_{22}-CH_3$
$CH_2-O-CO-(CH_2)_{22}-CH_3$

14) $CH_2-OH$
$CH-OH$
$CH_2-O-CO-(CH_2)_{26}-CH_3$

-continued

15) $CH_2-OH$
$CH-OH$
$CH_2-O-CO-(CH_2)_{22}-CH_3$

16)

$CH_3-(CH_2)_{26}-COO-CH_2-C(CH_3)(CH_2-O-CO-(CH_2)_{26}-CH_3)-CH_2-O-CO-(CH_2)_{26}-CH_3$

17)

$CH_3-(CH_2)_{20}-COO-CH_2-C(CH_2CH_3)(CH_2-O-CO-(CH_2)_{20}-CH_3)-CH_2-O-CO-(CH_2)_{20}-CH_3$

18)

$CH_3-(CH_2)_{26}-COO-CH_2-C(CH_2-O-CO-(CH_2)_{26}-CH_3)_2-CH_2-O-CO-(CH_2)_{26}-CH_3$

19)

$CH_3-(CH_2)_{24}-COO-CH_2-C(CH_2-O-CO-(CH_2)_{24}-CH_3)_2-CH_2-O-CO-(CH_2)_{24}-CH_3$

20)

$CH_3-(CH_2)_{22}-COO-CH_2-C(CH_2-O-CO-(CH_2)_{22}-CH_3)_2-CH_2-O-CO-(CH_2)_{22}-CH_3$

21)

$CH_3-(CH_2)_{20}-COO-CH_2-C(CH_2-O-CO-(CH_2)_{20}-CH_3)_2-CH_2-O-CO-(CH_2)_{20}-CH_3$

22)

$CH_3-(CH_2)_{18}-COO-CH_2-C(CH_2-O-CO-(CH_2)_{18}-CH_3)_2-CH_2-O-CO-(CH_2)_{18}-CH_3$

23)

$CH_3-(CH_2)_{16}-COO-CH_2-C(CH_2-O-CO-(CH_2)_{16}-CH_3)_2-CH_2-O-CO-(CH_2)_{16}-CH_3$

24)

$CH_3-(CH_2)_{14}-COO-CH_2-C(CH_2-O-CO-(CH_2)_{14}-CH_3)_2-CH_2-O-CO-(CH_2)_{14}-CH_3$

25)

$CH_3-(CH_2)_{12}-COO-CH_2-C(CH_2-O-CO-(CH_2)_{12}-CH_3)_2-CH_2-O-CO-(CH_2)_{12}-CH_3$

-continued

26)

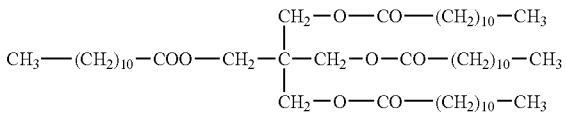

<Content of the Releasing Agent>

The content ratio of the releasing agent in the toner is commonly from 1 to 30 percent by weight of the toner, is preferably from 2 to 22 percent by weight, and is particularly preferably from 1 to 15 percent by weight.

<Resin Particles Comprising Releasing Agents>

The resin particles containing releasing agents may be obtained as latex particles by dissolving releasing agents in monomers to obtain binding resins, and then dispersing the resulting monomer solution into water based medium, and subsequently polymerizing the resulting dispersion.

Weight average particle size of the latex particles is preferably 50-2000 nm.

Listed as polymerization method employed to obtain resin particles, in which binding resins comprise releasing agents, may be granulation polymerization methods such as an emulsion polymerization method, a suspension polymerization method, a seed polymerization method, and the like.

The following method (hereinafter referred to as a "mini-emulsion method") may be cited as a preferable polymerization method to obtain resin particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding the water-soluble polymerization initiators, or along with the water-soluble polymerization initiators, oil-soluble polymerization initiators may be added to the monomer solution.

Herein, homogenizers which results in oil droplets in water dispersion, utilizing mechanical force, are not particularly limited, and may include "CLEARMIX" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binder Resins>

Binder resins, which constitute the toner, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of the sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of the sample is calculated employing a calibration curve which is prepared employing monodispersed polystyrene as standard particles. Approximately ten polystyrenes samples are preferably employed for determining the calibration curve.

Material and preparation process of resin particles are described.

Monomer Material

Radical polymerizable monomer is necessary component, and crosslinking agent may be employed when necessary as the polymerizable monomer. It is preferred to contain at least one of the following radical polymerizable monomer having acid group or base group.

(1) Radical Polymerizable Monomer

Radical polymerizable monomer is employed without restriction. One, two or more monomers are employed in combination so as to satisfy the required characteristics.

Practically, aromatic vinyl monomer, (meta)acrylate monomer, vinyl ester monomer, vinyl ether monomer, monoolefin monomer, diolefin monomer, halogenated olefin monomer etc. are exemplified.

Examples of the aromatic vinyl monomer are styrene or styrene derivatives such as styrene, o-methylstyrene, m-methylstyrene, p-methylstyrene, p-methoxylstyrene, p-phenylstyrene, p-chlorostyrene, p-ethylstyrene, p-n-butylstyrene, p-t-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene.

Examples of the (meta)acrylic acid ester are methylacrylate, ethylacrylate, butylacrylate, 2-ethylhexylacrylate, cyclohexylacrylate, phenylacrylate, methylmethacrylate, ethylmethacrylate, butylmethacrylate, 2-ethylhexylmetaacrylate, β-hydroxyaethacrylate, γ-aminopropylacrylate, stearylmethacrylate, dimethylaminoethyl methacrylate, and diethylaminoethyl methacrylate.

Examples of the vinyl ester monomer are vinyl acetate, vinyl propionate and vinyl benzoate.

Examples of the vinyl ether monomer are vinyl methyl ether, vinyl ethyl ether, vinyl isobutyl ether and vinyl phenyl ether.

Examples of the monoolefin monomer are ethylene, propylene, isobutylene, 1-butene, and 1-pentene, 4-methyl-1-pentene.

Examples of the diolefin monomer are butadiene, isoprene, and chloroprene.

Examples of the halogenated olefin monomer are vinyl chloride, vinylidene chloride, and vinyl bromide.

(2) Crosslinking Agent

Radical polymerizable crosslinking agent can be added so as to improve toner characteristics. Examples of the radical polymerizable crosslinking agent are those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Radical Polymerizable Monomer Having Acid Group or Base Group

Examples of the radical polymerizable monomer having acid group or base group are carboxyl group containing monomer, sulfonic acid containing monomer, and amine compound such as primary amine, secondary amine, tertiary amine, quaternary amine.

Examples of the carboxyl group containing monomer are acrylic acid, methacrylic acid, fumaric acid, maleic acid, itaconic acid, cinnamic acid, maleic monobutylate, maleic monooctylate.

Examples of the sulfonic acid group containing monomer are styrenesulfonic acid, allylsulfosuccinic acid, octyl allylsulfosuccinate.

These may be in the form of alkali metal salt such as sodium and potassium, or alkali earth metal salt such as calcium.

Examples of the radical polymerization monomer containing base is listed as amine compounds, specifically, dimethylaminoethylacrylate, dimethylaminoethylmetacrylate, diethylaminoethylacrylate, diethylaminoethylmetacrylate, and quaternary ammonium slat of the above four compounds, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, metacrylamide, N-butylmetacrylamide, N-octadecyl acrylamide; vinyl N-methylpyridinium chloride, vinyl N-ethyl pyridinium chloride, N,N-diallyl methylammonium chloride and N,N-diallyl ethylammonium chloride.

As for the amount of the radical polymerization monomer, radical polymerizable monomer containing acid group or base group is 0.1 to 15 weight % based on the total amount of the monomers. The amount of the radical polymerization crosslinking agent, which varies depending on its property, is 0.1 to 10 weight % based on the whole radical polymerizable monomers.

[Chain Transfer Agents]

Aiming at the adjustment of molecular weight, generally used chain transfer agents may be employed.

The chain transfer agents are not specially limited. Examples include mercapatans such as octylmercaptan, dodecylmercaptan, tert-dodecylmercaptan, etc.

[Polymerization Initiators]

Water-soluble radical polymerization initiators may be optionally employed. For example, are listed persulfate salts (potassium persulfate, ammonium persulfate, etc.), azo series compounds (4,4'-azobis-4-cyano valeic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature of 50° C. to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

[Surface Active Agents]

Surface active agent is employed in polymerization using the radical polymerizable monomer.

Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc., sulfonic ester salts such as sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

[Colorants]

Colorants include dyes, inorganic pigments and organic pigments.

Inorganic Pigments

Inorganic pigments capable of employing in the toner may be employed. Specific inorganic pigments are shown in the following.

Black pigments include, for example, carbon blacks such as furnace black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight % of a polymer and preferably in the range of 3 to 15 weight %.

Magnetite mentioned above may be added when used as a magnetic toner. Preferable amount is 20 to 60 weight % in the toner.

Organic Pigments

Organic pigments which may be employed in toner may be employed. In the following, specific organic pigments are shown.

Pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, C.I. Pigment Yellow 156, etc.

Pigments for green or cyan include C.I. Pigment Blue 15, C.I. Pigment Blue 15:2, C.I. Pigment Blue 15:3, C.I. Pigment Blue 16, C.I. Pigment Blue 60, C.I. Pigment Green 7, etc.

Further, as for die, C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent red 122, C.I. solvent yellow 44, C.I. solvent red 122, C.I. solvent yellow 77, C.I. solvent red 122, C.I. solvent yellow 79, C.I. solvent red 122, C.I. solvent yellow 81, C.I. solvent red 122, C.I. solvent yellow 82, C.I. solvent red 122, C.I. solvent yellow 93, C.I. solvent red 122, C.I. solvent yellow 98, C.I. solvent red 122, C.I. solvent yellow 103, C.I. solvent red 122, C.I. solvent yellow 104, C.I. solvent red 122, C.I. solvent yellow 112, C.I. solvent red 122, C.I. solvent yellow 162, C.I. solvent red 122, C.I. solvent blue 25, C.I. solvent blue 36, C.I. solvent blue 60, C.I. solvent blue 70, C.I. solvent blue 93, C.I. solvent blue 95 may be used.

These organic pigments may be employed individually or in combination of a plurality of them in accordance with requirements. Furthermore, the addition amount of the pigment is generally in the range of 2 to 20 weight % for a polymer and preferably in the range of 3 to 15 weight %.

Surface Improving Agents

The colorant may be used after subjecting to surface modification by employing surface improving agent. Specifically, may be preferably employed silane coupling agent, titanium coupling agent, aluminum coupling agent, etc.

[External Additive]

The so-called external additive can be employed for the purpose of improving fluid characteristics or cleaning ability so as to give an adaptability of recycle toner. The external additive includes various inorganic particles, organic particles and lubricant.

Inorganic particles may be used as external. Preferably employed as inorganic particles are fine particles of silica, titania and alumina. These inorganic fine particles are preferably hydrophobic. Specific example of silica fine particles, includes marketing product of R-805 R-976, R-974, R-972, R-812 and R-809 made by Nihon Aerosil Co., Ltd., HVK-2150 and H-200 made by Hoechst Company, and TS-720 TS-530, TS-610, H-5, MS-5 made by Cabot company.

Example of titanium fine particles includes marketing product of T-805 and T-604 made by Nihon Aerosil Co., Ltd., MT-100S, MT-100B, MT-500BS, MT-600, MT-600SS and JA-1, made by Teika company, TA-300SI, TA-500, TAF-130, TAF-510 and TAF-510T made by Fuji Titanium Company, and IT-S, IT-OA, IT-OB, IT-OC made by Idemitsu Kosan Company.

Example of alumina fine particles includes marketing product RFY-C and C-604 made by Nihon Aerosil Co. Ltd., and TTO-55 made by Ishihara Sangyo company is made.

As organic fine particles, spherical organic fine particles having number average primary particle size of 10 to 2000 nm may be used. Examples of the organic fine particles are listed as homopolymer or copolymer of styrene resin, methylmethacrylate resin.

Example of the lubricant mentioned above includes metallic salt of higher fatty acid such as stearic acid salt of zinc, aluminum, copper and magnesium, oleic acid salt of calcium, zinc, manganese, iron, copper and magnesium, palmitic acid salt of zinc, copper, magnesium and calcium, linoleic acid salt of zinc and calcium, and ricinoleic acid salt of zinc and calcium.

The external additives are preferably contained in amount of 0.1 to 5 weight % based on toner amount.

The toner is preferably a coalesced type toner obtained by salting out/fusing resin particles comprising releasing agents and colorant particles in water based medium. By salting out/fusing the resin particles comprising releasing agents, as described above, a toner is obtained in which the releasing agents are finely depressed.

In addition, the toner preferably possesses an uneven surface from the production stage, and a coalesced type toner is obtained by fusing resin particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner is as follows:

(1) a dissolution process in which releasing agents are dissolved in monomers and a monomer solution is prepared (2) a dispersion process in which the resulting monomer solution is dispersed into water based medium (3) a polymerization process in which the resulting water based dispersion of the monomer solution undergoes polymerization so that dispersion (latex) of resin particles comprising the releasing agents is prepared (4) a salting-out/fusion process in which the resulting resin particles and the colorant particles are subjected to salting-out/fusion in water based medium so as to obtain coalesced particles (colored particles)

(5) a filtration and washing process in which the resulting coalesced particles are collected from the water based medium employing filtration, and surface active agents and the like are removed from the coalesced particles (6) a drying process in which washed coalesced particles are dried, and (7) an external addition process may be included in which external agents are added to the dried coalesced particles.

(Dissolution Process)

Methods for dissolving releasing agents in monomers are not particularly limited.

The dissolved amount of the releasing agents in the monomers is determined as follows: the content ratio of releasing agents is generally 1 to 30 percent by weight based on the finished toner, is preferably 2 to 20 percent by weight, and is more preferably 3 to 15 percent by weight.

Further, oil-soluble polymerization initiators as well as other oil-soluble components may be incorporated into the monomer solution.

(Dispersion Process)

Methods for dispersing the monomer solution into water based medium are not particularly limited. However, methods are preferred in which dispersion is carried out employing mechanical force. The monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gatlin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-Out/Fusion Process)

In the salting-out/fusion process, a colorant particle dispersion is added to a dispersion containing resin particles obtained by the polymerization process so that the resin particles and the colorant particles are subjected to salting-out/fusion in a water based medium.

Further, in the salting-out/fusion process, resin particles as well as colorant particles may be fused with internal agent particles and the like.

"Water based medium", as described in the salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in the salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "CLEARMIX", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing the reaction, colorants are collected by filtration and repeatedly washed with the same solvent. Subsequently, the washed colorants are dried to obtain the colorants (pigments) which are treated with the surface modifiers.

The salting-out/fusion process is accomplished as follows. Salting-out agents, containing alkaline metal salts and/or alkaline earth metal salts and the like, are added to water comprising resin particles as well as colorant particles as the coagulant at a concentration of higher than critical aggregation concentration. Subsequently, the resulting aggregation is heated above the glass transition point of the resin particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as the organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resin particles and colorant particles is heated as soon as possible and heated to a temperature higher than the glass transition point of the resin particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resin particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, the rate is preferably not more than 15° C./minute.

Further, after the dispersion containing resin particles and colorant particles is heated to a higher temperature than the glass transition point, it is important to continue the salting-out/fusion by maintaining the temperature of the dispersion for a specified period of time. By so doing, it is possible to effectively proceed with the growth of toner particles (aggregation of resin particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In the filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing Buchner's funnel and the like, a filtration method which is carried out employing a filter press, and the like.

(Drying Process)

The washed toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

The moisture content of dried toner particles is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a HENSCHEL MIXER, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, HENSCHEL MIXERs, Nauter mixers, V-type mixers, and the like.

It is preferable to control the temperature during the salting-out/fusion narrow for obtaining toner particles satisfying proportion of number of toner particles having a diameter of at most 0.7×(Dp50). More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner. Specifically, charge control agents are cited. The agents may be added employing various methods such as one in which during the salting-out/fusion stage, the charge control agents are simultaneously added to resin particles as well as colorant particles so as to be incorporated into the toner, another is one in which the charge control agents are added to resin particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

The water content of toner according to the present invention is 0.1-2.0 weight % under condition of 30 C degree, 80% RH. The water content of toner can be adjusted by the following methods.

The concrete toner water content adjusting method;

1) Increase the quantity of hydrophobic compositions of toner, especially its binder resin.

2) Lower the water content of the external additive agent of toner. It may be effective for it to make a degree of hydrophobilization of the external additive agent high as described later. It is desirable to use one having the degree of hydrophobilization of the external additive agent of 60 or more.

3) To increase an amount of a non-polar releasing agent which exists on the surface may be an effective method. In order to do so, it may be especially suitable to use polyolefin based wax. In order to increase an amount of polyolefin existing on the surface, there is a method to make it bleed out from the surface of toner by providing frictional heat at the time of crashing by the use of a mechanical grinder.

4) Adjust an amount of carboxylic acid on the surface of toner.

A range of water content

Water content of toner according to the present invention is 0.1 to 2.0 mass under 30° C. 80% RH environment, more preferably 0.2 to 1.8 mass %.

Measuring Method of Water Content of Toner

After putting toner into the Fischer sample bottle, It is left while opening the bottle under 30° C. and 80% RH ambient for 72 hours. Having left it, the bottle is sealed and the water content is measures by a Karl Fischer technique. A measuring instrument is a Hiranuma type automatic fine water measurement device AQS-724, and as a measurement condition, a vaporization temperature is set to 110° C., and a vaporization time is set to 25 seconds.

<Developers>

The toner may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. The toner may be employed in both developers.

Further, the toner is blended with a carrier and employed as a two-component developer. In this case, employed as magnetic particles of the carrier may be conventional materials known in the art, such as metals such as iron, ferrite, magnetite, and the like, alloys of the metals with aluminum, lead and the like. Specifically, ferrite particles are preferred. The 50% volume particle diameter of the magnetic particles is preferably 15 to 100 μm, and is more preferably 25 to 80 μm.

The 50% volume particle diameter of the carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute the resin dispersion type carriers are not particularly limited, and resins known in the art may be employed. For example, listed may be styrene-acryl based resins polyester resins, fluorine based resins, phenol resins, and the like.

A organic photoreceptor is described. It may be desirable that the organic photoreceptor used for the present invention comprises, on a cylindrical conductive base support, an intermediate layer containing inorganic particles having a number average primary particle diameter of 3-200 nm in a binder resin, and a light-sensitive layer.

When the organic photoreceptor has the structure as described above, the generation of the fog or the density poor-ness of the leading edge part which are easily generated by the counter developing mode, can be prevented, and the high image quality digital image or color image can be provided.

Next, a organic photoreceptor will be explained.

The organic photoreceptor refers to an electrophotographic photoconductor or organic photoreceptor equipped with at least one of a charge generating function essential to the configuration of the electrophotographic photoconductor, and a charge transport function. It includes all the photoconductors composed of the commonly known organic charge generating materials or organic charge transfer materials, and the known organic photoconductors such as the photoconductor wherein the charge generating function and charge transfer function are provided by the high-molecular complex.

The structure of the photo sensitive body has preferably a structure in which a charge generating layer and a charge transporting layer are laminated one by one as a light sensitive layer on a conductive support. Furthermore, it is desirable to prepare an intermediate layer between the conductive support and a light sensitive layer, and it may make it a structure in which a surface protecting layer is further formed on the light sensitive layer as needed.

Hereinafter, a preferable concrete example of a later structure of a organic photoreceptor according to the present invention will be explained.

Conductive Support:

A sheet-like or cylindrical conductive support may be used as the conductive support for the photo sensitive body.

The cylindrical conductive support can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions, being restricted thereto. The average thickness of the film formed by anodization is normally equal to or smaller than 20 μm, and is preferred to be equal to or smaller than 10 μm, in particular.

Moreover, in the organic photoreceptor, when the outside diameter of a cylindrical base support is 20-80 mm, effect of the invention becomes larger. When the outside diameter of the cylindrical base support is 20-80 mm, the surface linear velocity of the organic photoreceptor in an image formation process tends to become high-speed, and it is easy to generate image unevenness and fog by a counter developing mode.

Intermediate Layer:

An intermediate layer is provided between the conductive supporting member and photosensitive layer in the organic photoreceptor. In the intermediate layer, inorganic particles having a number average primary particle diameters of 3-200 nm are contained in a binder resin. With the structure in which inorganic particles are contained in a binder resin of the intermediate layer, the blocking capability for free carriers (electron and hole which come from a conductive base support) from a conductive base support can be improved, the generation of black spots or fog can be prevented, and the developing capability can be increased, the generation of unevenness can be prevented so that electro-photographic picture images with an enough image density can be obtained.

As inorganic particles used for the intermediate layer, metal oxides, such as a titanium oxide (TiO2), a zinc oxide (ZnO), a tin oxide (SnO2), a zirconium oxide, a cerium oxide, an iron oxide, an aluminium oxide, a tungstic oxide, and a bismuth oxide, are used preferably, and further, metallic carbide, such as silicon carbide and titanium carbide, titanate such as strontium titanate, titanic acid calcium, and barium titanate, carbonate such as calcium carbonate, metal nitrides, such as aluminium nitride, and sulfate such as barium sulfate, copper sulfate, and zinc sulfate etc. may be used.

Among these inorganic particles, inorganic particles may be N-type semiconductive particles desirably. The N-type semiconductive fine particles means that main charge carriers are particles of electrons. That is, since main charge carriers are particles of electrons, the intermediate layer in which the N-type semiconductive fine particles are contained in the insulating binder, effectively blocks the hole injection from the conductive base support and has a property having a transporting capability for the electron from the photosensitive layer.

The N-type semiconductive particles include the particles of titanium oxide ($TiO_2$), zinc oxide (ZnO) and tin oxide ($SnO_2$), and the titanium oxide is preferable.

The number average primary particle diameter is preferably 3.0 nm to 200 nm, more preferably 5 to 100 nm. The number average primary particle size of the N type semiconductive fine particles described above is obtained by the following. For example, the titanium oxide particles are magnified by a factor of 10,000 according to a transmission electron microscope, and one hundred particles are randomly selected as primary particles from the magnified particles, and are obtained by measuring an average value of the FERE diameter according to image analysis. The intermediate layer using the N-type semiconductive particles where the number average primary particle diameter is within the aforementioned range permits dispersion in the layer to be made more compact, and is provided with sufficient potential stability and black spot preventive function.

The N-type semiconductive particles are configured in a branched, needle-shaped or granular form. These N-type semiconductive particles—for example, in the case of titanium oxide—are available in various crystal types such as anatase, rutile and amorphous type. Of these types, the rutile type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

A hydrogenpolysiloxane compound is preferably used as the reactive organic silicon compound to be used in the last surface treatment of the N-type semiconductive particles. The hydrogenpolysiloxane having a molecular weight of from 1,000 to 20,000 is easily available and shows a suitable black spot inhibiting ability, and gives good half tone image.

The polymer containing a methylhydrogensilixane unit is preferably a copolymer of a structural unit of —(HSi($CH_3$)O)— and another siloxane unit. Preferable another siloxane unit is a dimethylsiloxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

The N-type semiconductor particle may be one subjected to surface treatment by a reactive organic compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl) ethyl group; a (metha)acryloyl group-containing group such as a γ-acryloxypropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more.

The N-type semiconductor particle may be subjected to a surface treatment by alumina or silica before the surface treatment by the nethylhydrogensiloxane copolymer or the reactive organic silicone compound.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

The surface treatment of the N-type semiconductor fine particle such as titanium oxide by alumina, silica or zirconia can be performed by a wet method. For example, the surface-treated N-type semiconductor particle can be prepared as follows.

When titanium oxide particle is employed as the N-type semiconductor particle, aqueous slurry is prepared by dispersing titanium oxide particles having a number average primary particle diameter of 50 nm in a concentration of from 50 to 350 g/L, and a water-soluble silicate or a water-soluble aluminum compound is added to the slurry. After that, the slurry is neutralized by adding an alkali or an acid so as to precipitate silica or alumina onto the surface of the titanium oxide particles. And then the particles are filtered, washed and dried for obtaining the objective surface-treated titanium oxide. When sodium silicate is employed as the water-soluble silicate, the neutralization can be carried out by an acid such as sulfuric acid, nitric acid hydrochloric acid. When aluminum sulfate is employed as the water-soluble aluminum compound, the neutralization can be performed by an alkali such as sodium hydroxide and potassium hydroxide.

An intermediate layer coating liquid prepared for forming the intermediate layer employed in the invention is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic organic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole % of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 5

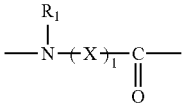

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 6

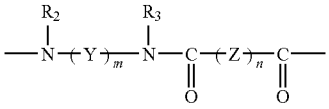

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30, preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

When the number of carbon atoms is smaller than 7, the hygroscopic property of polyamide resin becomes larger, the humidity dependency of photographic properties, particularly potential on the occasion of the repeating use becomes larger, further the image defects such as the black spots easily occur and a halftone image deteriorates. On the other hand, when the number of carbon atoms is larger than 30, the solubility of polyamide in solvent for coating composition becomes poor not to be adequate for forming a coating layer of an intermediate layer.

Further, the ratio of a repeating unit structure having a carbon atom number of 7 to 30 among amide bonds, occupying in all repetition unit structure is smaller than 40 mol %, the above effect becomes small.

Polyamide resin having a repeating unit structure represented by Formula 3 are preferred.

Formula 3

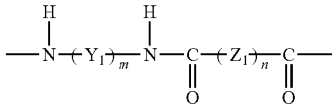

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

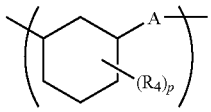

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

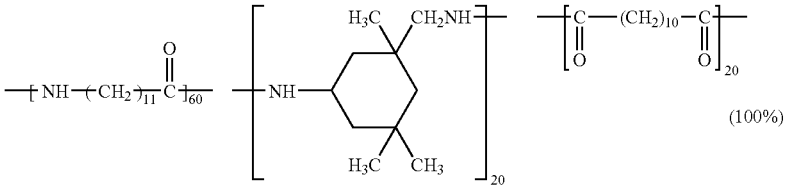

(100%)

-continued
N-2
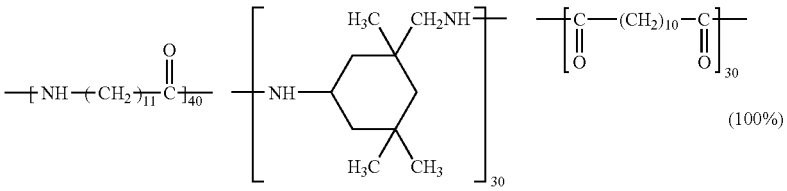
(100%)
N-3
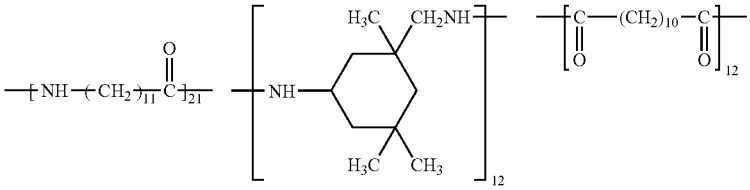
N-4
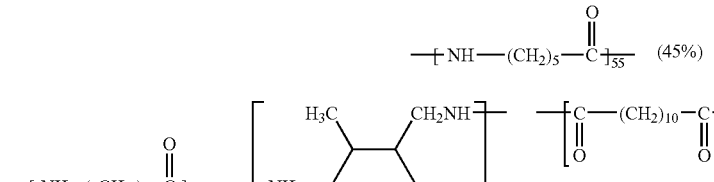
(45%)
N-5
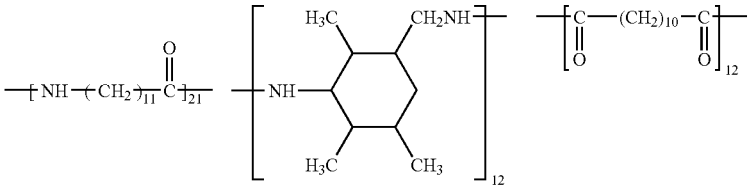
(45%)
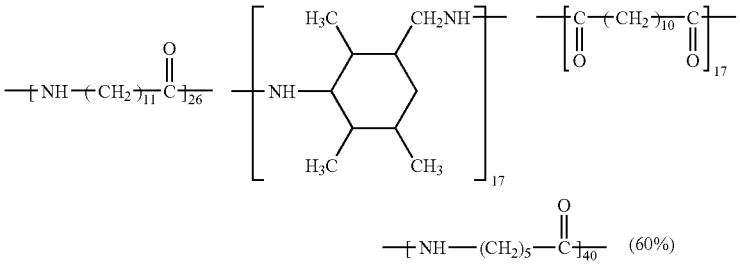
(60%)
N-6
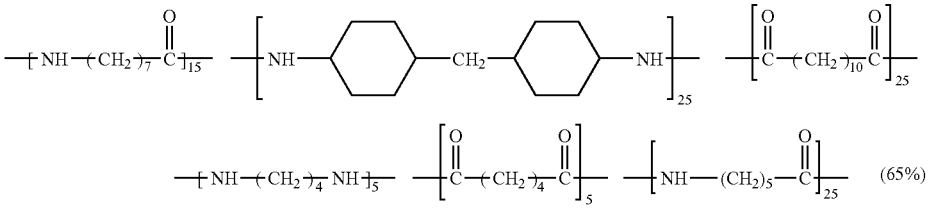
(65%)
N-7
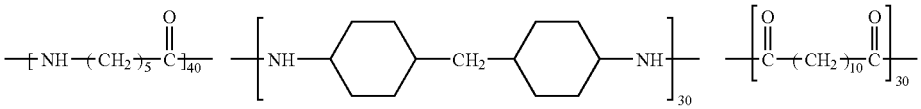
(60%)
N-8
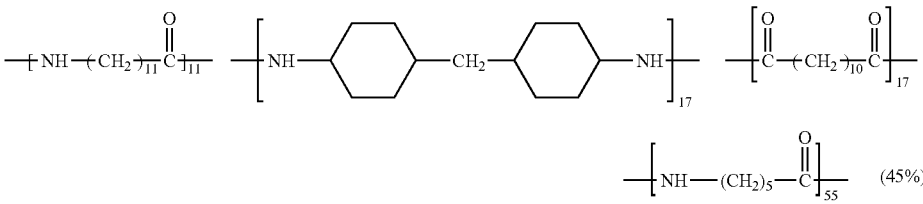
(45%)

-continued

N-9

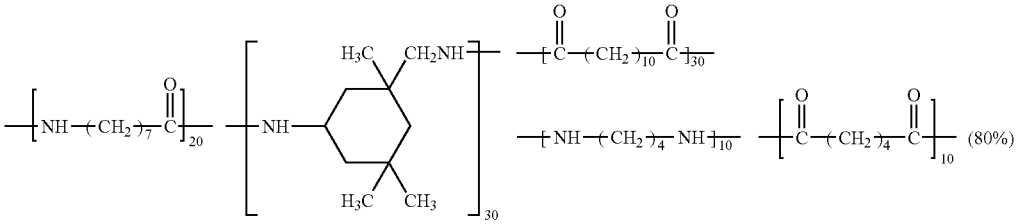

N-10

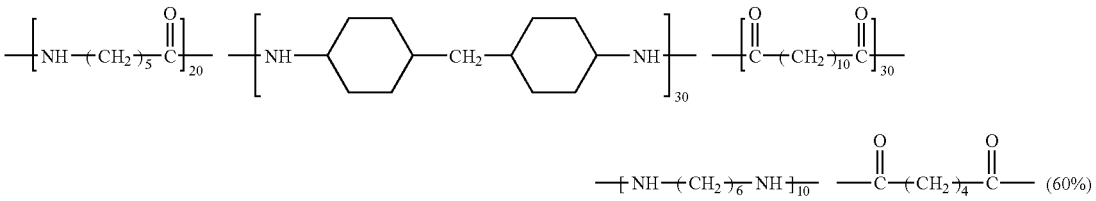

N-11

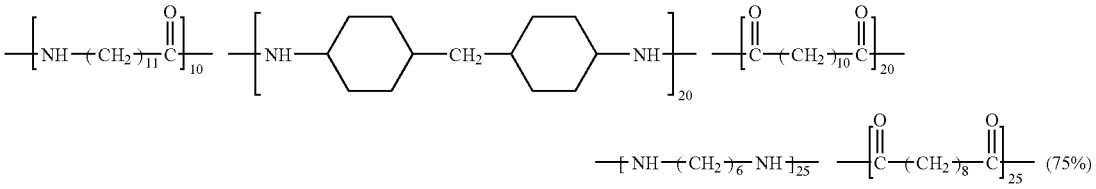

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel•Degussa Ltd., are available in the market, and it is easy to prepare in a usual method. An example of the synthesis method is described.

Synthesis of Exemplified Polyamide Resin N-1

In a polymerization kettle, to which a stirrer, nitrogen, a nitrogen gas introducing pipe, a thermometer and a dehydration tube were attached, 215 parts by weight of lauryllactam, 112 parts by weight of 3-aminomethyl-3,5,5-trimethylcyclohexylamine, 153 parts by weight of 1,12-dodecane dicarboxylic acid and 2 parts by weight of water were mixed and reacted for 9 hours while applying heat and pressure and removing water by distillation. The resultant polymer was taken out and the composition of the copolymer was determined by $C^{13}$—NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μm, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^8$ Ω·cm. The volume resistivity of the interlayer and the protective layer is preferably from $1\times10^8$ to $1\times10^{15}$ Ω·cm, more preferably from $1\times10^9$ to $1\times10^{14}$ Ω·cm, and further preferably from $2\times10^9$ to $1\times10^{13}$ Ω·cm. The volume resistivity can be measured as follows.

Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

When volume resistance becomes less than $1\times10^8$, an intermediate layer's electric charge blocking tendency falls, generation of a black spot increases, the potential holdout of a organic photoreceptor also deteriorates, and excellent image quality may be not acquired. On the other hand, when it becomes larger than $10^{15}$ Ω·cm, a residual potential on a repeating image formation will tend to increase, and an excellent image quality will not be acquired.

As a solvent for preparing the coating solution for forming an intermediate layer, it can be selected arbitrary from a well-known organic solvent, for example, an alcoholic based solvent, an aromatic based solvent, a halogenated hydrocarbon based solvent, a ketone based solvent, a ketone alcohol based solvent, an ether based solvent, an ester based solvent, etc.

For example, a usual organic solvent, such as methanol, ethanol, n-propanol, iso-propanol, n-butanol, benzyl alcohol, methylselsolb, ethylselsolb, acetone, methyl ethyl ketone, cyclohexanone, methyl acetate, an ethylacetate, acetic acid n-butyl, dioxane, tetrahydrofuran, methylene chloride, chloroform, chlorobenzene, and toluene, can be used.

Moreover, these solvents used for dispersion can be used solely or in a mixture of to kinds or more. When mixed, as a usable solvent, any one can be used if it can solve a binder resin as a mixed solvent.

As a way of dispersing the inorganic particles having subjected to a surface treatment by the use of a coupling agent etc. in a binder resin, the method of a roll mill, a ball mill, an oscillating ball mill, an atolighter, a sandmill, a colloid mill, a paint shaker, etc. can be used.

Light Sensitive Layer

Charge Generating Layer (CGL)

A charge generating layer is a layer which contains charge generating materials (CGM) as a main component, and binder resin may be used for it if needed.

As a charge generating material, a well-know material can be used. For example, a phthalocyanine based pigment, such as a metal phthalocyanine and a non-metal phthalocyanine, an azrenium salt pigment, a square rick acid metin pigment, an azo pigment having a carbazole frame, an azo pigment having a triphenylamine frame, an azo pigment having a diphenylamine frame, an azo pigment having a dibenzo thiophene frame, an azo pigment having a fluorenone frame, an azo pigment having an oxydiazole frame, an azo pigment having a bis stilbene frame, an azo pigment having a distyryl oxydiazole frame, an azo pigment having a distyryl carbazole frame, a perylene based pigment, an anthraquinone based or multi-ring quinone based pigment, a quinone imine based pigment, a diphenylmethane and triphenylmethane based pigment, benzoquinone and naphthoquinone based pigment, cyanine and azo methine based pigment, an indigo based pigment, and a bis benzimidazole based pigment, etc. may be used.

Among the above CGM, when a phthalocyanine based pigment is used, the effect of the present invention appears significantly. Although a organic photoreceptor employing a titanyl phthalocyanine pigment, or a gallium phthalocyanine pigment, etc. as an electric charge generating material tends to change its potential characteristic easily, if the intermediate layer according to a present invention is used, potential change is improved, whereby even if an image forming method of a counter developing mode is used, the generation of fog can be prevented, and the generation that image density is lowered partially on a image leading portion and so on can be prevented.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably 20 to 600 weight parts of a charge generating material for 100 weight parts of the binder resin. An increase in residual electric potential with repeated use can be minimized by using these resins. The layer thickness of the charge generating layer is preferably in the range of 0.3 to 2 μm.

Charge Transporting Layer (CTL)

A charge transporting layer is a layer aiming to hold a charging charge and to combine by shifting a charge which generates and separates in a charge generating layer by exposure with the holding charging charge. In order to attain the object to hold the charging charge, a high electric resistance is required. Further, in order to attain the object to obtain a high surface potential with the holding charging charge, a low permittivity and a good charge transporting ability are required. The relevant charge transporting layer satisfying these requirements is structured by a charge transporting material (CTM) and a binder resin used as needed. The charge transporting layer can be formed by dissolving or dispersing these charge transporting materials and the binder resin into a suitable solvent and by coating and drying these materials. For the relevant charge transporting layer, as needed, in addition to the charge transporting material and the binder resin, a proper quantity of additives, such as plasticizer, antioxidant, and leveling agent etc, can also be added. As an electric charge transporting material, although there are a positive hole transporting material and an electron transporting material, in the layer structure of the organic photoreceptor, the positive hole transporting material is desirable.

A charge transporting layer contains a charge transporting material (CTM) and a binder resin for dispersing the CTM and forming a layer. The charge transporting layer may contain additives if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As a charge transporting material according to the invention, a material in which the mobility of charge is relatively high, the dispersibility into the inside of a binder is excellent and the potential characteristics is stable is preferable, especially, the compound of the following general formula (4) is more desirable.

General formula (4)

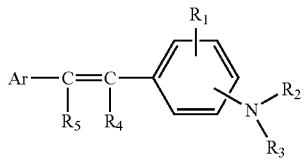

In the general formula (4), R1 represents a hydrogen atom, an alkyl group, an alkoxy group, or a halogen atom, R2 and R3 represented a substituted or unsubstituted alkyl group, a substituted or unsubstituted aralkyl group or a substituted or unsubstituted aryl group, R2 and R3 are same with or different from each other. R4 and R5 represent a hydrogen atom, a low-grade alkyl group, or a substituted or unsubstituted aryl group, Ar represents a substituted or unsubstituted aryl group, and Ar and R5 may combine with each other so as to form a ring.

CTM-1
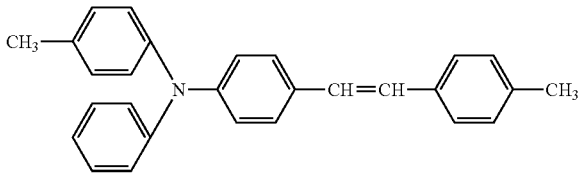
CTM-2
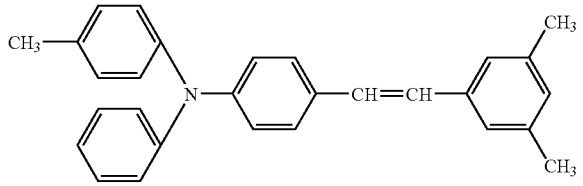
CTM-3
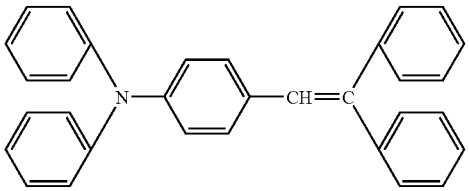
CTM-4
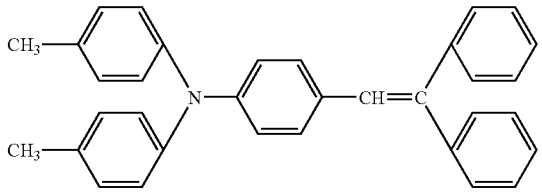
CTM-5
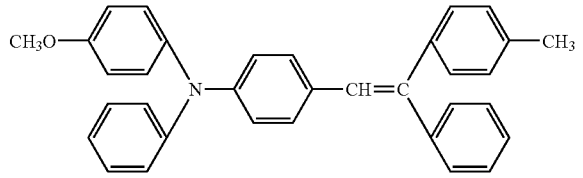
CTM-6
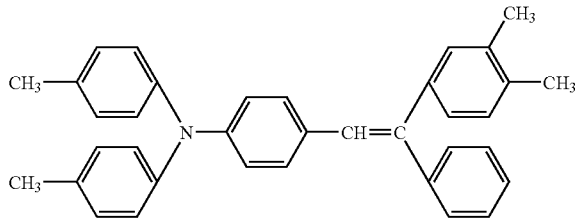
-continued
CTM-7
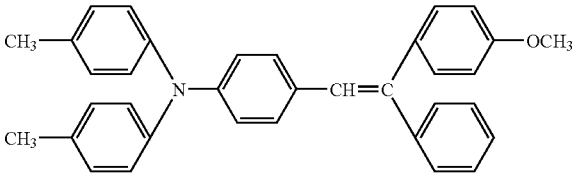
CTM-8
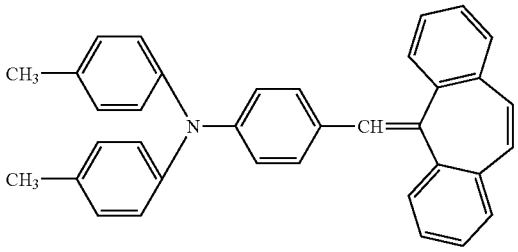
CTM-9
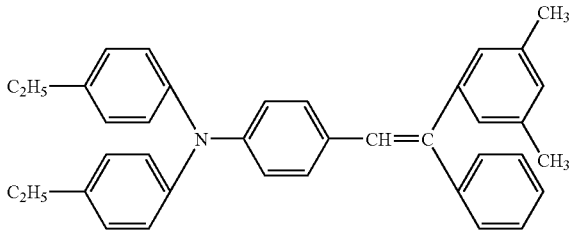
CTM-10
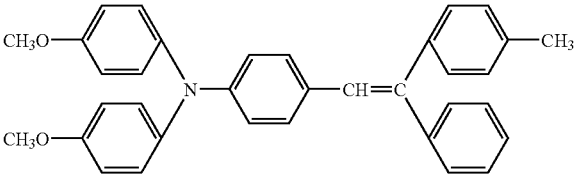
CTM-11
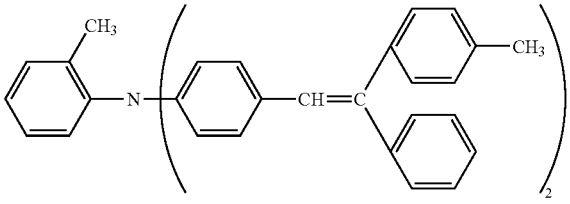
CTM-12
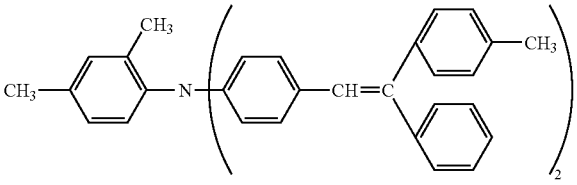

-continued

CTM-13

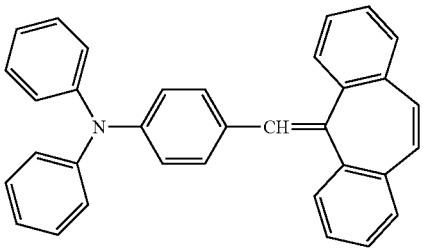

CTM-14

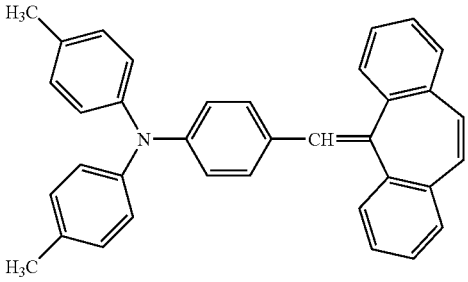

CTM-15

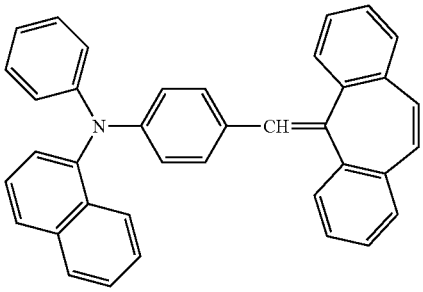

CTM-16

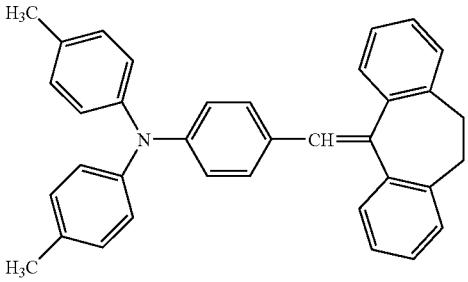

-continued

CTM-17

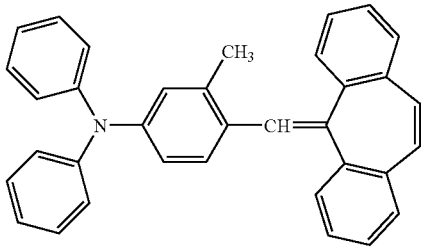

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly —N— vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by weight to 100 parts of charge transporting material by weight. Total thickness of the CTL is preferably not more than 20 μm, more preferably 10 to 16 μm. If the thickness exceeds 20 μm, it may cause increase of residue of potential or lower of image sharpness due to increase of adsorption or scattering of laser with short wave.

Moreover, it is preferable to make the surface layer containing the fluorine-containing resin fine particles contain an antioxidant. Although the surface layer containing a fluorine-containing resin fine particles tends to oxidize with activated gas at the time of charging of a organic photoreceptor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in a organic photoreceptor or on the surface of a organic photoreceptor. Typically, the following compound groups are listed.

1-1

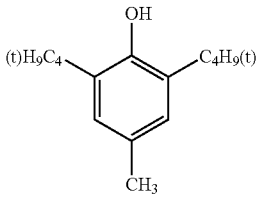

1-2

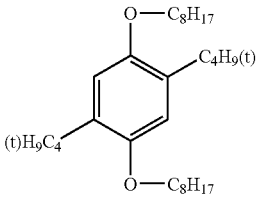

1-3

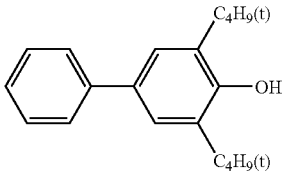

1-4

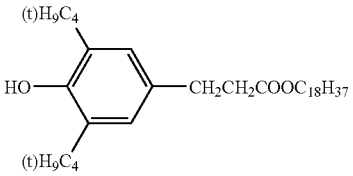

-continued
1-5
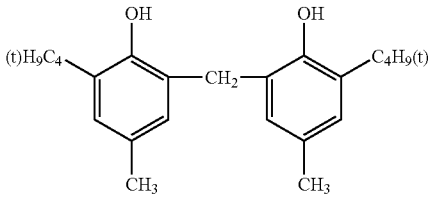
1-6
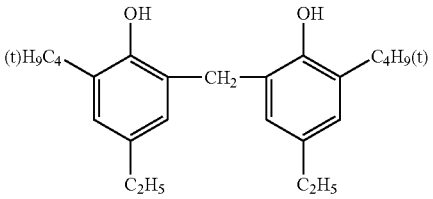
1-7
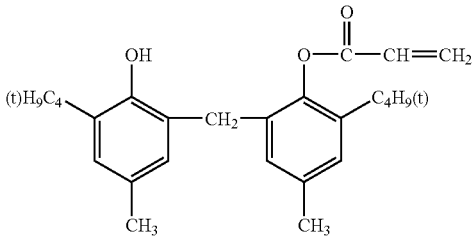
1-8
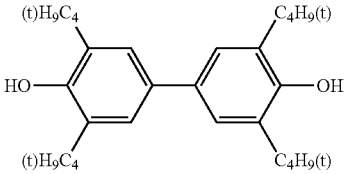
1-9
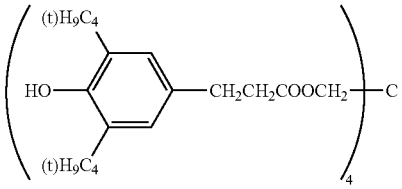
1-10
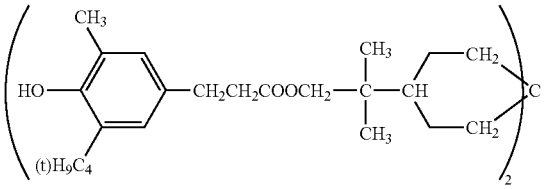
1-11
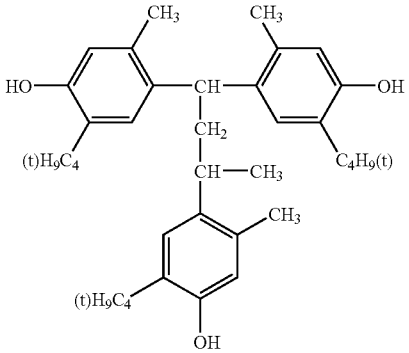
2-1
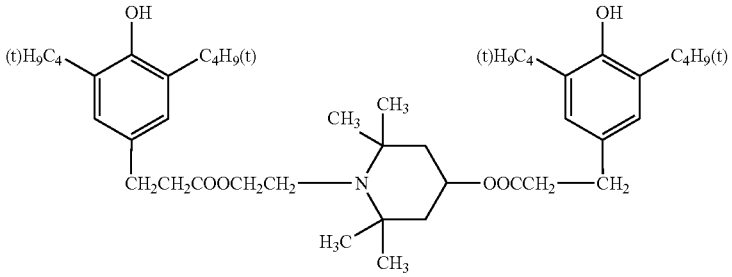

-continued 2-2

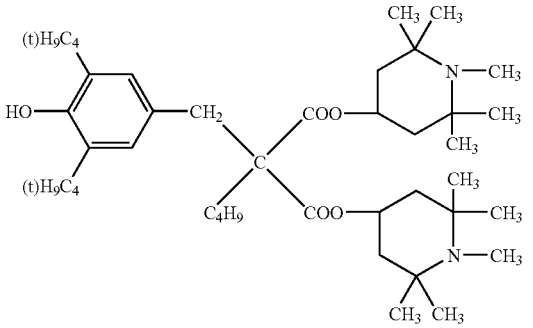

2-3

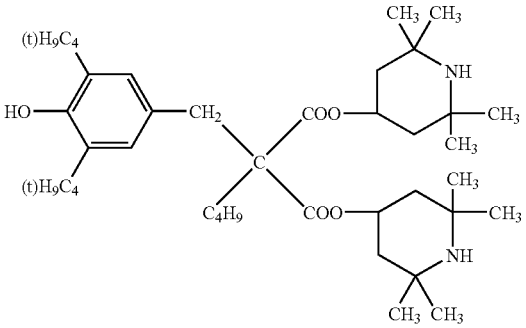

2-4

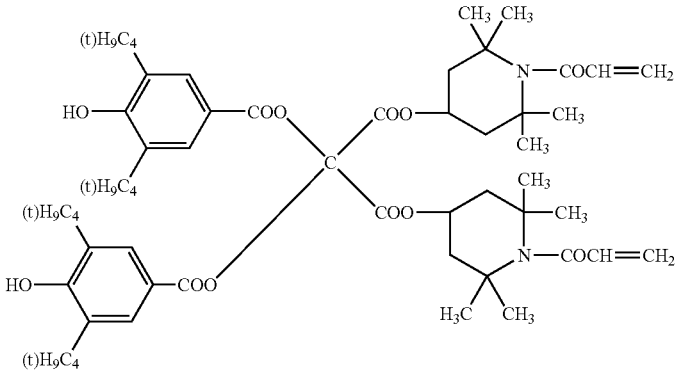

2-5

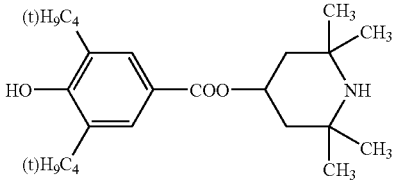

2-6

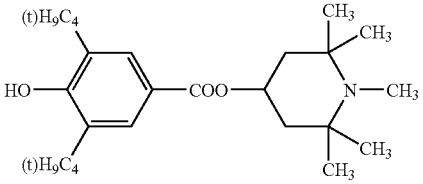

2-7

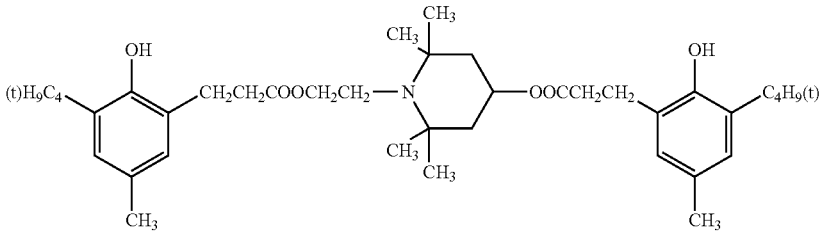

Moreover, the structure in which the uppermost layer of the organic photoreceptor contains fluorine-containing resin fine particles is desirable. By making the uppermost layer contain fluorine-containing resin fine particles, a transferring ability of a toner image formed on the organic photoreceptor to a transfer sheet is enhanced and the reproducibility of a dot image can be increased.

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

Referring to FIG. 1, the developing device of the counter developing mode will be described. Incidentally, the developing device shown in FIG. 1 is a developing device with a contact type two component developing method. However, the invention is not limited to the contact type two component developing method. For example, the invention is applied to a non-contact type one component developing method. The developing device 102 is arranged in such a manner that, at the opening part of the developing container 110 in which two-component developer is accommodated, the developing sleeve (a developing agent carrying member) 120 in which cylindrical magnet 121 is non-rotationally arranged, is arranged oppositely to the organic photoreceptor (an image carrying member) 101, and this developing sleeve 120 is rotated in the counter direction to the organic photoreceptor 101 rotating in the arrowed direction, and the developer attracted to and held on its surface is conveyed to a developing section opposed to the organic photoreceptor 101. The magnet 121 has the developing magnetic pole N1 on the organic photoreceptor 101 side, and has, from this developing magnetic pole N1 to the rotation direction of the developing sleeve 120, the first conveying magnetic pole S3, the second conveying magnetic pole N2, the third conveying magnetic pole S2 and a draw-up magnetic pole S1 in which the third conveying magnetic pole and a separation magnetic pole are structured.

The developer in the developing container 110 is attracted and held on the developing sleeve 120 by the action of the draw-up pole S1, at the position (draw-up position) Q on the surface of the developing sleeve 120 corresponding to the draw-up magnet pole S1 of the magnet 121, and arrives at the developing section after the layer thickness is regulated by the developing blade (a developing agent layer thickness regulating member) 122, and in the developing section, the magnetic brush (developing brush) is formed by the action of the developing magnetic pole N1, and the latent image on the organic photoreceptor 101 is developed.

The developer whose toner density is lowered by the development, is held on the developing sleeve 120 and returned to the inside of the developing container 110 by the action of the first, second conveying magnet poles S3, N2, and at the position (developer falling position) P on the surface of the developing sleeve 120 whose magnetic flux density is smallest, between the third conveying magnet pole S2 and the draw-up magnet pole S1, it is peeled off from the developing sleeve 120, and is dropped. On the developing sleeve from which the developer is peeled off, as described above, the new developer is attracted and held at the draw-up position Q.

Below the developing sleeve 120 in the developing container 110, the first mixing conveying member 123 is provided, and the second mixing conveying member 124 is further provided through the partition wall 140. These first, second mixing conveying members 123, 124 are screw type ones, and have spiral screw blade 128 and plate-like protrusion 130 between collars of its blade.

The developer whose toner density is low, which is peeled off from the developing sleeve 120, drops on the first mixing conveying member 123, and mixing-conveyed by the first mixing conveying member 123 together with the neighboring developer in the axial direction, and passes through the opening, not shown, of the one end portion of the partition wall 140, and it is delivered to the second mixing conveying member 124. The second mixing conveying member 124 conveys the delivered developer and the toner replenished from the replenishing port 118 of the developing container 110 while mixing them, in the rotation direction reverse to the above description, and passing through the opening, not shown, of the other end portion of the partition wall 140, returns them to the first mixing conveying member 123 side.

A preferred embodiment of a counter developing mode is explained. Incidentally, here, a gap between the organic photoreceptor 101 and the developing sleeve 120 in the developing section neighboring the developing magnet N1 in FIG. 1 is called a developing gap (Dsd), and the height of the magnetic brush formed on the developing sleeve 120 by the developing magnet N1 is called a developing brush height (h).

(1) Developing Gap (Dsd): 0.2 to 0.6 mm

When Dsd is made 0.2 to 0.6 mm, the development is conducted under a strong developing electric field and the attraction force to attract magnetic carriers onto the developing sleeve become larger so that the magnetic carriers are prevented from shifting and adhering onto the organic photoreceptor. Further, the developing electric field in the developing gap becomes higher, an edge effect becomes reduced and a developing ability is enhanced. Therefore, thinning of a transverse line image and a whitening of a trailing edge portion (developing failure at a trailing edge portion) can be prevented and the developing ability for a solid image can be enhanced.

(2) Magnetic Brush Bent Depth (Bsd): 0 to 0.8 mm, Here, the Magnetic Brush Bent Depth (Bsd)=the Developing Brush Height (h)−the Developing Gap (Dsd)

When the magnetic brush bent depth (Bsd) is made 0 to 0.8 mm, the compression for the developing agent at the developing section is reduced and developing agent is prevented from slipping through a gap between the developing sleeve 120 and the developing blade 122. A developing failure for an isolating dot caused by an uneven contact of a magnetic brush and an increase of a roughness on a halftone image can be prevented. When the magnetic brush bent depth (Bsd) is less than zero, that is, under non contact condition, lowering of a developing density tends to take place. On the other hand, when the magnetic brush bent depth (Bsd) is larger than 0.8 mm, the developing agent flows out from a nip section and a even image formation is not expected.

(3) Peripheral speed ratio of developing sleeve to organic photoreceptor (Vs/Vopc): 1.2 to 3.0 and, preferably, 1.5 to 2.5.

When the peripheral speed ratio of developing sleeve to organic photoreceptor (Vs/Vopc) is made 1.2 to 3.0, a high developing ability can be obtained. If the peripheral speed ratio is increased excessively, the contact frequency of magnetic brush on the developing sleeve against the organic photoreceptor becomes high excessively. Then, the contacting force of the magnetic brush against the organic photoreceptor, that is, a mechanical force becomes strong excessively and carrier tends to separate away from the magnetic brush and the carrier tends to adhere onto the organic photoreceptor. As a result, a brush mark is caused on a toner image on the organic photoreceptor by the magnetic brush. On the contrary, if the peripheral speed ratio is decreased excessively, the contact frequency of magnetic brush on the developing sleeve against the organic photoreceptor reduces excessively, the developing ability is lowered. Therefore, when the peripheral speed ratio is less than 1.2, the image density becomes low, and when the peripheral speed ratio is larger than 3.0, toner scattering, carrier adhesion, a durability problem of the developing sleeve may take place. In contrast, when the peripheral speed ratio is made within the above range, the brush mark can be prevented. Further, the edge effect is prevented from being enhanced due to an excessive high developing ability.

(4) Developing Bias Condition

It is desirable that a difference |Vo−Vdc| between the surface electric potential Vo of the organic photoreceptor and a direct-current component Vdc of a developing bias is made 100 to 300 V, a direct-current component Vdc of a developing bias is made −300 V to −650 V, an alternate current component Vac of the developing bias is made 0.5 to 1.5 KV, frequency is made 3 to 9 KHz, duty ratio is made 45 to 70% (the time ratio of the developing side in a rectangular wave), the shape of the alternate current component is made to be a rectangular wave. Namely, in a small size two component type developing apparatus in which the outer diameter of the developing sleeve is 30 mm or less and the outer diameter of the organic photoreceptor is 60 mm or less, since a developing nip width becomes small due to the small diameter of the developing sleeve, the developing ability becomes lowered. However, with the above developing bias condition, the lowering of the developing ability can be improved.

Next, a process cartridge and the electronic photographing apparatus according to the present invention will be described. A schematic structure of the electronic photographing apparatus having the process cartridge having the organic photoreceptor is shown in FIG. 2.

Figure 2:
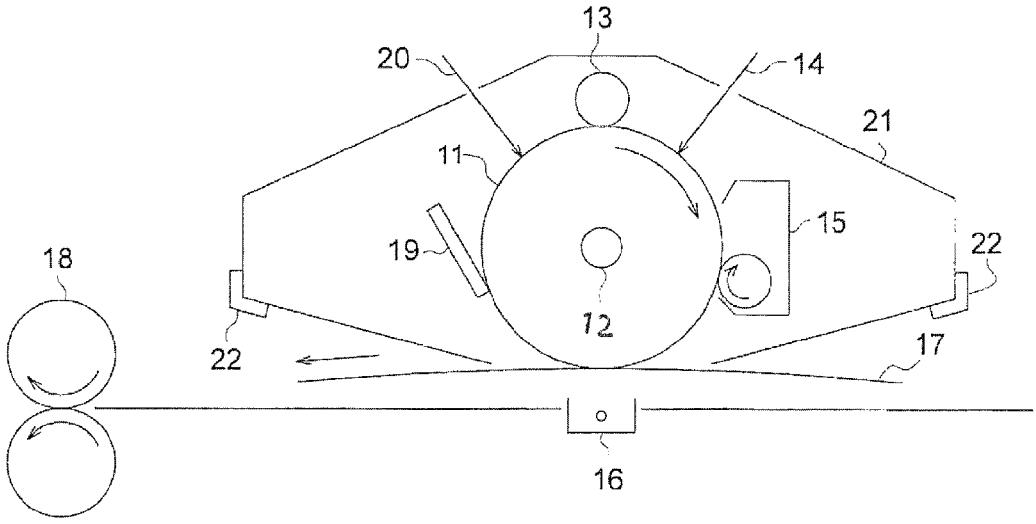
FIG. 2 is a view showing an example of schematic structure of an electronic photographing apparatus having a process cartridge having an organic photoreceptor of the present invention.

In FIG. 2, numeral 11 is a drum-like organic photoreceptor, and is rotated at a predetermined peripheral speed in the arrowed direction around the axis 12. In the rotation process, the organic photoreceptor 11 receives the uniform charging of the positive or negative predetermined potential on its peripheral surface by the primary charging means 13, next, receives the emphasized and modulated exposure light 14 corresponding to the time series electric digital image signal of the image information for the purpose that it is outputted from the exposure means (not shown) such as a slit exposure or laser beam scanning exposure. In this manner, on the peripheral surface of the organic photoreceptor 11, electro-static latent images corresponding to a target image information are successively formed.

The formed electro-static latent image is next toner-developed by the developing means 15, and onto the transfer material 17 which is taken out and fed from the sheet feeding section, not shown, in timed relationship with the rotation of the organic photoreceptor 11 between the organic photoreceptor 11 and the transfer means 16, the toner images which are formed and held on the surface of the organic photoreceptor 11, are successively transferred by the transfer means 16.

The transfer material 17 onto which the toner image is transferred, is separated from the surface of the organic photoreceptor and when it is introduced into the image fixing means 18 and image-fixed, printed out to the outside of the apparatus as the image formed material (print, copy).

The surface of the organic photoreceptor 11 after the image transferring, is cleaned when the remained toner of the transferring is removed by the cleaning means 19, and further after the surface is discharging-processed by the pre-exposure light 20 from the pre-exposure means (not shown), it is repeatedly used for the image formation. Hereupon, when the primary charging means 13 is a contact charging means using the charging roller, the pre-exposure is not always necessary.

In the present invention, in the components such as the above organic photoreceptor 11, primary charging means 13, developing means 15 and cleaning means 19, a plurality ones are accommodated in a casing 21 and structured by being integrally combined as a process cartridge, and this process cartridge may also be detachably structured for the electronic photographing apparatus main body such as the copier or laser beam printer. For example, at least one of the primary charging means 13, developing means 15 and cleaning means 19, is integrally supported with the organic photoreceptor 11 and made into the cartridge, and by using the guiding means 22 such as rails of the apparatus main body, it can be made a process cartridge which is detachable for the apparatus main body.

Further, an embodiment of a printer of the electronic photographing system (hereinafter, simply called printer) as the full-color image forming apparatus to which the present invention is applied, will be described bellow.

Figure 3:
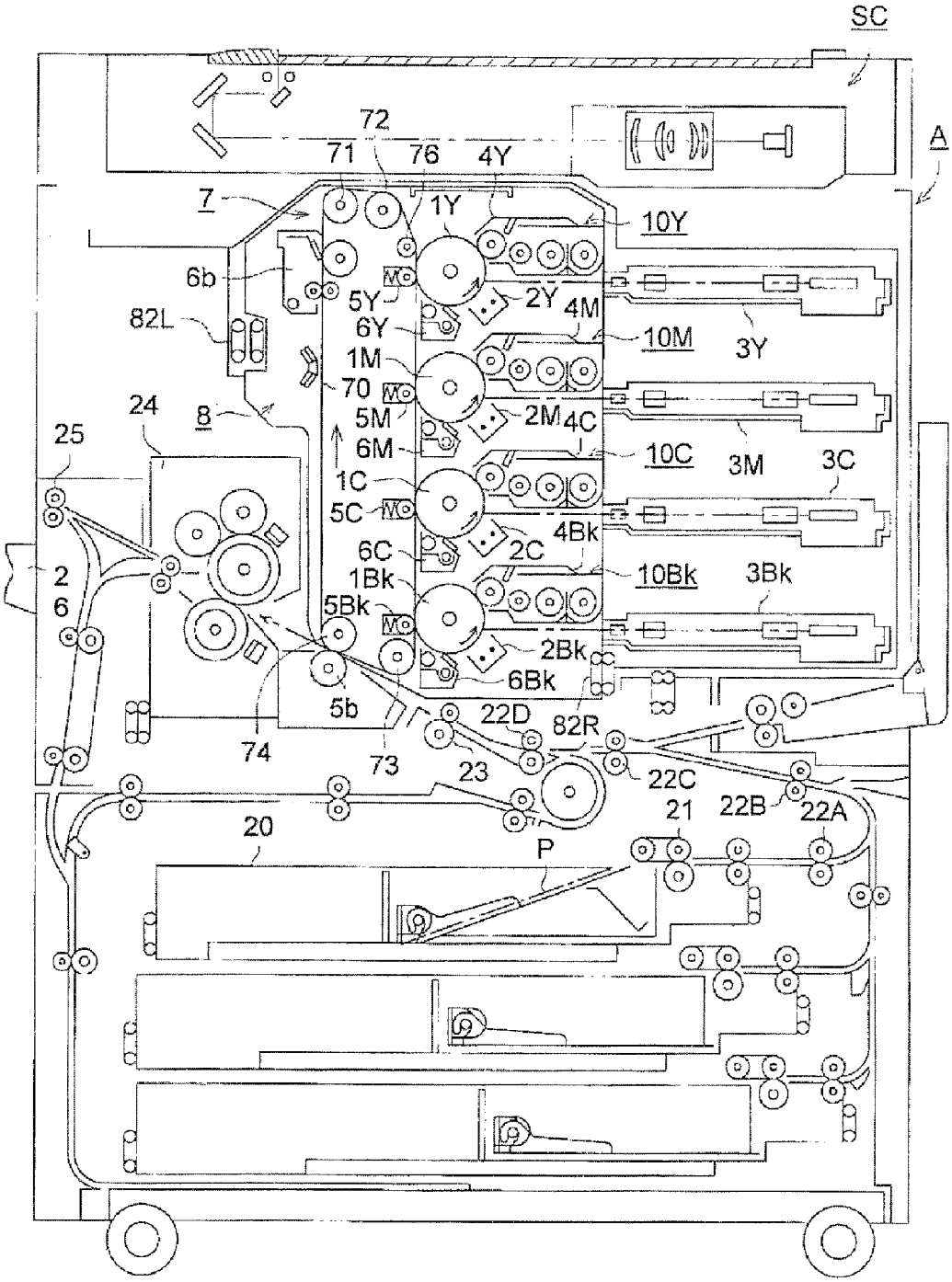
FIG. 3 is a schematic structural view of a printer which is an example of an image forming apparatus of the present invention.

FIG. 3 is a cross-sectional configuration view diagram of a color image forming apparatus showing a preferred embodiment of the present invention. In this embodiment, the image forming method, comprising the steps of (a) forming an electrostatic latent image;

(b) forming a developing brush with a developing agent containing toner on a developing sleeve;

(c) visualizing the electrostatic latent image with bringing the developing brush onto the organic photoreceptor while the developing sleeve is rotated in a direction counter to that of the organic photoreceptor at the developing section;

(d) conducting the steps of (a) through (c) for each of the plural different colors for respective organic photoreceptors;

(e) transferring the plural different colors from the respective organic photoreceptors to an intermediate transfer member; and (f) transferring the superimposed different color toner images onto a recording material;

wherein the developing agent contains toner which contains toner particles having a particle diameter of 0.7× (Dp50) or less in an amount of 8 number % or less and has water content of 0.1 to 2.0 mass % under an environment of 30° C. and 80% RH, where Dp50 represents 50% number particle diameter of toner particles.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation means 21, and a fixing means 24. The original document reading apparatus SC is placed on top of the main unit A of the image forming apparatus.

The image forming section 10Y that forms images of yellow color comprises a charging means (charging process) 2Y, an exposing means (exposing process) 3Y, a developing means (developing process) 4Y, a primary transfer roller 5Y as a primary transfer means (primary transfer process), and a cleaning means 6Y all placed around the drum shaped organic photoreceptor 1Y which acts as the first image supporting body. The image forming section 10M that forms images of magenta color comprises a drum shaped organic photoreceptor 1M which acts as the first image supporting body, a charging means 2M, an exposing means 3M, a developing means 4M, a primary transfer roller 5M as a primary transfer means, and a cleaning means 6M. The image forming section 10C that forms images of cyan color comprises a drum shaped organic photoreceptor 1C which acts as the first image supporting body, a charging means 2C, an exposing means 3C, a developing means 4C, a primary transfer roller 5C as a primary transfer means, and a cleaning means 6C. The image forming section 10Bk that forms images of black color comprises a drum shaped organic photoreceptor 1Bk which acts as the first image supporting body, a charging means 2Bk, an exposing means 3Bk, a developing means 4Bk, a primary transfer roller 5Bk as a primary transfer means, and a cleaning means 6Bk.

The four sets of image forming units 10Y, 10M, 10C, and 10Bk are constituted, centering on the photosensitive drums 1Y, 1M, 1C, and 1Bk, by the rotating charging means 2Y, 2M, 2C, and 2Bk, the image exposing means 3Y, 3M, 3C, and 3Bk, the rotating developing means 4Y, 4M, 4C, and 4Bk, and the cleaning means 5Y, 5M, 5C, and 5Bk that clean the photosensitive drums 1Y, 1M, 1C, and 1Bk.

The image forming units 10Y, 10M, 10C, and 10Bk, all have the same configuration excepting that the color of the toner image formed in each unit is different on the respective photosensitive drums 1Y, 1M, 1C, and 1Bk, and detailed description is given below taking the example of the image forming unit 10Y.

The image forming unit 10Y has, placed around the photosensitive drum 1Y which is the image forming body, a charging means 2Y (hereinafter referred to merely as the charging unit 2Y or the charger 2Y), the exposing means 3Y, the developing means 4Y, and the cleaning means 5Y (hereinafter referred to merely as the cleaning means 5Y or as the cleaning blade 5Y), and forms yellow (Y) colored toner image on the photosensitive drum 1Y. Further, in the present preferred embodiment, at least the photosensitive drum 1Y, the charging means 2Y, the developing means 4Y, and the cleaning means 5Y in this image forming unit 10Y are provided in an integral manner.

The charging means 2Y is a means that applies a uniform electrostatic potential to the photosensitive drum 1Y, and a corona discharge type of charger unit 2Y is being used for the photosensitive drum 1Y in the present preferred embodiment.

The image exposing means 3Y is a means that carries out light exposure, based on the image signal (Yellow), on the photosensitive drum 1Y to which a uniform potential has been applied by the charging means 2Y, and forms the electrostatic latent image corresponding to the yellow color image, and an array of light emitting devices LEDs and imaging elements (product name: SELFOC LENSES) arranged in the axial direction of the photosensitive drum 1Y or a laser optical system etc., is used as this exposing means 3Y.

In the image forming method of the present invention, in the time of forming an electrostatic latent image on a organic photoreceptor, it is desirable that to perform image-wise exposure with a light exposure beam having a spot area of 2000 $\mu m^2$ or less. Even if conducting image-wise exposure with such a light exposure beam of a small diameter, the organic photoreceptor according to the present invention can form faithfully an picture image corresponding to the spot area. The more preferable spot area is 100 to 1000 $\mu m^2$. As a result, an electrophotography picture image having a good gradation can be formed with 800 dpi (dpi: the number of dots per 25.4 cm) or more.

When a light exposure beam is cut along a plane perpendicular to the beam, the spot area of the light exposure beam means an area corresponding to the region in which the intensity of the exposure beam is $1/e^2$ or more times the peak intensity in a light intensity distribution surface which appears in the sectional plane.

The optical beams used can be a scanning optical system using a semiconductor laser or a fixed scanner using LEDs, etc. The light intensity distribution can be Gaussian distribution or Lorentz distribution, and in either case, the area with a light intensity of $1/e^2$ or more than the peak intensity is considered as the spot area according to the present invention.

The intermediate image transfer body unit 7 in the shape of an endless belt is wound around a plurality of rollers, and has an endless belt shaped intermediate image transfer body 70 which acts as a second image carrying body in the shape of a partially conducting endless belt which is supported in a free to rotate manner.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer means, thereby forming the synthesized color image. The transfer material P as the transfer material stored inside the sheet feeding cassette 20 (the supporting body that carries the final fixed image: for example, plain paper, transparent sheet, etc.) is fed from the sheet feeding means 21, pass through a plurality of intermediate rollers 22A, 22B, 22C, and 22D, and the resist roller 23, and is transported to the secondary transfer roller 5*b* which functions as the secondary image transfer means, and the color image is transferred in one operation of secondary image transfer on to the transfer material P. The transfer material P on which the color image has been transferred is subjected to fixing process by the fixing means 24, and is gripped by the sheet discharge rollers 25 and placed above the sheet discharge tray 26 outside the equipment. Here, the transfer supporting body of the toner image formed on the organic photoreceptor of the intermediate transfer body or of the transfer material, etc. is comprehensively called the transfer media.

On the other hand, after the color image is transferred to the transfer material P by the secondary transfer roller 5*b* functioning as the secondary transfer means, the endless belt shaped intermediate image transfer body 70 from which the transfer material P has been separated due to different radii of curvature is cleaned by the cleaning means 6*b* to remove all residual toner on it.

During image forming, the primary transfer roller 5Bk is at all times pressing against the organic photoreceptor 1Bk. Other primary transfer rollers 5Y, 5M, and 5C come into pressure contact respectively with their corresponding organic photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photosensitive drums 1Y, 1M, 1C, and 1Bk. The endless belt shaped intermediate image transfer body unit 70 comprises the endless belt shaped intermediate image transfer body 70 that can rotate around the rollers 71, 72, 73, and 74, the primary image transfer rollers 5Y, 5M, 5C, and 5Bk, and the cleaning means 6*b*.

Figure 4:
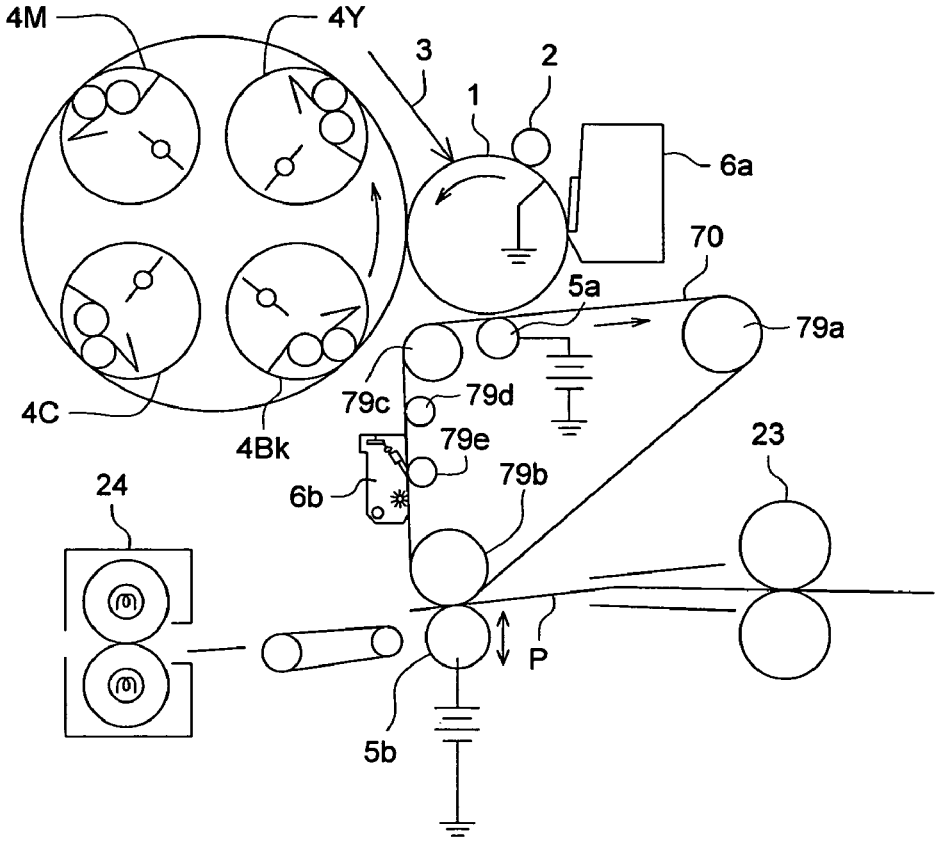
FIG. 4 is a schematic structural view of a modified apparatus example of the printer which is an example of the image forming apparatus of the present invention.

Next, FIG. 4 shows the cross-sectional configuration view diagram of a color image forming apparatus using an organic photoreceptor (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70. In this embodiment, the image forming method, comprising the steps of:

(a) forming an electrostatic latent image;

(b) forming a developing brush with a developing agent containing toner on a developing sleeve;

(c) visualizing the electrostatic latent image with bringing the developing brush onto the organic photoreceptor while the developing sleeve is rotated in a direction counter to that of the organic photoreceptor at the developing section, and (d) transferring the toner image to an intermediate transfer member;

(e) conducting the steps of (a) through (d) for each of plural different colors so as to superimpose the plural different color toner images on the intermediate transfer member; and (f) transferring the superimposed different color toner images onto a recording material;

wherein the developing agent contains toner which contains toner particles having particle diameter of 0.7×(Dp50) or less in an amount of 8 number % or less and has water content of 0.1 to 2.0 mass % under an environment of 30° C. and 80% RH, where Dp50 represents 50% number particle diameter of toner particles.

In this figure, 1 is a rotating drum type organic photoreceptor that is used repetitively as the image carrying body, and is driven to rotate with a specific circumferential velocity in the anti-clockwise direction shown by the arrow.

During rotation, the organic photoreceptor 1 is charged uniformly to a specific polarity and potential by the charging means (charging process) 2, after which it receives from the image exposing means (image exposing process) 3 not shown in the figure image exposure by the scanning exposure light from a laser beam modulated according to the time-serial electrical digital pixel signal of the image information thereby forming the electrostatic latent image corresponding to the yellow (Y) color component (color information) of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the organic photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the organic photoreceptor 1.

The yellow toner image of the first color formed and retained on the organic photoreceptor 1 is, in the process of passing through the nip section between the organic photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 5*a* to the intermediate image transfer body 70.

The surface of the organic photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the organic photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the organic photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 24 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment.

Examples

Although examples are given and this invention is hereafter explained to details, the aspect of this invention is not limited to this. Incidentally, "part" in the following sentences represents "parts by weight".

Toner and the developer using the toner which are used for the present invention were produced.

Next, toner was produced as described below.

Production of Toner 1Bk

After melting and kneading 100 parts of styrene-acryl resin composed of mass ratios of styrene:butyl acrylate:butyl methacrylate=80:10:10, 10 parts of carbon black, and 5 parts of low-molecular-weight polypropylene (number average molecular weight=3500), fine grinding was performed for the mixture with a mechanical grinder and a careful classification was carried out for them with an air classification machine, colored particles having a 50% volume particle diameter (Dv50) of 8.1 μm were obtained. For this colored particles, 1.2 mass % of hydrophobic silica (a degree of hydrophobilization=80/a number average primary particle diameter=12 nm) were added to obtain toner. This toner is referred as "Toner 1Bk".

Production of Toner 2Bk

After melting and kneading 100 parts of styrene-acryl resin composed of mass ratios of styrene:butyl acrylate:butyl methacrylate:acrylic acid=75:18:5:2, 10 parts of carbon black, and 5 parts of low-molecular-weight polypropylene (number average molecular weight=3500), fine grinding was performed for the mixture with a mechanical grinder and a careful classification was carried out for them with an air classification machine, colored particles having a 50% volume particle diameter (Dv50) of 8.1 μm were obtained. For this colored particles, 1.2 mass % of hydrophobic silica (a degree of hydrophobilization=80/a number average primary particle diameter=12 nm) were added to obtain toner. This toner is referred as "Toner 2Bk".

Production of Toner 3Bk

After melting and kneading 100 parts of styrene-acryl resin composed of mass ratios of styrene:butyl acrylate:methacrylic acid=70:20:10, 10 parts of carbon black, and 4 parts of low-molecular-weight polypropylene (number average molecular weight=3500), fine grinding was performed for the mixture with a mechanical grinder and a careful classification was carried out for them with an air classification machine, colored particles having a 50% volume particle diameter (Dv50) of 4.8 μm were obtained. For this colored particles, 1.2 mass % of hydrophobic silica (a degree of hydrophobilization=75/a number average primary particle diameter=12 nm) were added to obtain toner. This toner is referred as "Toner 3Bk".

Production of Toner 4Bk, Toner 4Y, Toner 4M, Toner 4C

Sodium n-dodecylsulfate of 0.90 kg and 10.0 L of pure water were put in a vessel and dissolved while being stirred. Then, this solution was gradually added with 1.20 kg of REGAL 330R (carbon black manufactured by Cabot Corp.) while stirring, then this solution was continuously dispersed by the use of a sand grinder (a medium type homogenizer) for successive 20 hours. As a result of measuring the particle size of the above-mentioned dispersion liquid by using an electrophoresis light-scattering photometer ELS-800 by an OTSUKA ELECTRONICS CO., LTD. company, it was 122 nm in weight average diameter. Moreover, the solid content concentration of the above-mentioned dispersion liquid measured with the weighing method by standing desiccation was 16.6 mass %.

This dispersion liquid was referred as "Colorant Dispersion Liquid 1."

0.055 kg of sodium dodecylbenzenesulfonate was mixed to ion-exchanged water of 4.0 L, and the mixture was stirred and dissolved under room temperature, whereby an anionic surface active agent solution A was obtained.

0.014 kg of nonyl phenyl alkyl ether was mixed to ion-exchanged water of 4.0 L, and the mixture was stirred and dissolved under room temperature, whereby a nonion surfactant solution A was obtained.

223.8 g of potassium persulfate was mixed to ion-exchanged water of 12.0 L, and the mixture was stirred and dissolved under room temperature, whereby an initiator solution A was obtained.

3.41 kg of polypropylene emulsion having a number average molecular weight (Mn) of 3500, the anionic surface active agent solution A, and the nonion surfactant solution A were put into a reaction chamber of 100 L which was attached with a temperature sensor, a cooling tube, and a nitrogen introduction device, and stirring was started for it. Then 4.4.0 L of ion-exchanged water were added.

Heating was started and the whole amount of "initiator solution A" was added when the solution temperature reached 75° C. Thereafter, 14.3 kg of styrene, 2.88 kg of n-butyl acrylate, 0.8 kg of methacrylic acid and 548 g of t-dodecyl mercaptan were added while the temperature was controlled at 75° C.±1° C.

Further, the solution temperature was raised to 80° C.±1° C., and stirred with heating for 6 hours. Then, the solution temperature was cooled down to not higher than 40° C. and stirring was stopped, followed by filtration through Pole Filter resulting in preparation of "Latex A1".

Herein, resin particles in Latex A1 had a glass transition temperature of 59° C., a softening point of 116° C., a weight average molecular weight of 13,400 as a molecular weight distribution, and a weight average particle diameter of 125 nm.

Potassium persulfate of 200.7 g was mixed to ion-exchanged water of 12.0 L, and stirring-under room temperature and dissolving was carried out. This solution was referred as an initiator solution B.

The nonion surfactant solution A was put into a reaction chamber of 100 L which was attached with a temperature sensor, a cooling tube, a nitrogen introduction device, and Kushigata baffle plate and stirring was started for it. Then 44.0 L of ion-exchanged water were added.

Heating was started and "initiator solution B" was added when the solution temperature reached 70° C. At this time, a solution in which 11.0 kg of styrene, 4.00 kg of n-butyl acrylate, 1.04 kg of methacrylic acid and 9.02 g of t-dodecyl mercaptan were mixed in advance, was added.

Thereafter, heating and stirring were performed for 6 hours while controlling the solution temperature at 72° C.±2° C. Further, the solution temperature was raised to 80° C.±2° C., and stirred with heating for 12 hours.

Then, the solution temperature was cooled down to not higher than 40° C. and stirring was stopped, followed by filtration through Pole Filter resulting in preparation of "Latex B1".

Herein, resin particles in Latex B1 had a glass transition temperature of 58° C., a softening point of 132° C., a weight average molecular weight of 245,000 as a molecular weight distribution and a weight average particle diameter of 110 nm.

Sodium chloride of 5.36 kg as a salting agent and ion-exchanged water of 20.0 L were put in, stirred and dissolved, whereby a sodium chloride solution A was obtained.

Latex A1 of 20.0 kg, Latex B1 of 5.2 kg, 0.4 kg of colorant dispersion 1 and 20.0 kg of ion-exchanged water were put and stirred in a 100 L SUS reaction vessel (agitating blades are anchor wings), equipped with a thermosensor, a cooling tube, a nitrogen gas introducing device and a Kushigata baffle plate. Subsequently, it was heated to 35° C. and sodium chloride solution A was added. Then, after leaving it alone for 5 minutes, temperature rising was started and the liquid temperature was raised to 85° C. in 5 minutes (heating rate=10° C./minutes). At the liquid temperature of 85° C.±2° C., heating and stirring was carried out for 6 hours, and salting-out/fusion were made. Thereafter, the solution was cooled down to not higher than 40° C. and stirring was stopped. It was filtered by a filter having a pore size of 45 μm, and let this filtrate was made as an association liquid. Then, non-spherical particles in a wet cake shape were obtained as a filtrate from the association solution by the use of a centrifuge. Thereafter the products was washed with ion-exchanged water.

Colored particles in the shape of a wet cake for which washing was completed in the above were dried by 40° C. warm air, and whereby colored particles were obtained. Furthermore, careful classification was carried out with an air classification machine, and whereby colored particles having a 50% volume particle size (Dv50) of 4.2 μm were obtained. Furthermore, 1.0 mass % of hydrophobic silica (a degree of hydrophobilization=70, a number average primary diameter=12 nm) were added to this colored particle, and whereby "toner 4Bk" was obtained.

"Toner 4Y" was obtained in the similar way in production of toner 4Bk with except that 8 parts of C.I. pigment yellow 185 was used instead of 10 parts of carbon black.

"Toner 4M" was obtained in the similar way in production of toner 4Bk with except that 10 parts of C.I. pigment red 122 was used instead of 10 parts of carbon black.

"Toner 4C" was obtained in the similar way in production of toner 4Bk with except that 5 parts of C.I. pigment blue 15:3 was used instead of 10 parts of carbon black.

Production of Toner 5Bk, Toner 5Y, Toner 5M, Toner 5C

Colored particles whose particle size was changed by changing the fusion condition of toner 4-Bk, were prepared. Furthermore, by conducing careful classification with an air classification machine, colored particles having a 50% volume particle size (Dv50) of 5.0 μm were obtained. 1.0 mass % of hydrophobic silica (hydrophobicity 75, number average primary particle diameter 12 nm) was added to the colored particles and thus obtained is toner 6Bk.

"Toner 5Y" was obtained in the similar way in production of toner 5Bk with except that 8 parts of C.I. pigment yellow 185 was used instead of 10 parts of carbon black.

"Toner 5M" was obtained in the similar way in production of toner 5Bk with except that 10 parts of C.I. pigment red 122 was used instead of 10 parts of carbon black.

"Toner 5C" was obtained in the similar way in production of toner 5Bk with except that 5 parts of C.I. pigment blue 15:3 was used instead of 10 parts of carbon black.

Production of Toner 6Bk, Toner 6Y, Toner 6M, Toner 6C

By changing the classification condition of Toner 5Bk, colored particles having a 50% volume particle size (Dv50) of 9.5 μm were obtained. 1.0 mass % of hydrophobic silica (a degree of hydrophobilization=70, a number average primary diameter=12 nm) were added to this colored particle, and whereby "toner 6Bk" was obtained.

"Toner 6Y" was obtained in the similar way in production of toner 6Bk with except that 8 parts of C.I. pigment yellow 185 was used instead of 10 parts of carbon black.

"Toner 6M" was obtained in the similar way in production of toner 6Bk with except that 10 parts of C.I. pigment red 122 was used instead of 10 parts of carbon black.

"Toner 6C" was obtained in the similar way in production of toner 6Bk with except that 5 parts of C.I. pigment blue 15:3 was used instead of 10 parts of carbon black.

Production of Toner 7Bk, Toner 7Y, Toner 7M, Toner 7C

After melting and kneading 100 parts of polyester resin having acid number of 45, 10 parts of carbon black, and 5 parts of low-molecular-weight polypropylene (number average molecular weight=3500), fine grinding was performed for the mixture with a mechanical grinder and a careful classification was carried out for them with an air classification machine, colored particles having a 50% volume particle diameter (Dv50) of 7.5 μm were obtained. For this colored particles, 1.2 mass % of hydrophobic silica (a degree of hydrophobilization=65/a number average primary particle diameter=12 nm) were added to obtain toner. This toner is referred as "Toner 7Bk".

"Toner 7Y" was obtained in the similar way in production of toner 7Bk with except that 8 parts of C.I. pigment yellow 185 was used instead of 10 parts of carbon black.

"Toner 7M" was obtained in the similar way in production of toner 7Bk with except that 10 parts of C.I. pigment red 122 was used instead of 10 parts of carbon black.

"Toner 7C" was obtained in the similar way in production of toner 7Bk with except that 5 parts of C.I. pigment blue 15:3 was used instead of 10 parts of carbon black.

Production of Toner 8Bk, Toner 8Y, Toner 8M, Toner 8C

After melting and kneading 100 parts of polyester resin having acid number of 45, 10 parts of carbon black, and 5 parts of low-molecular-weight polypropylene (number average molecular weight=3500), fine grinding was performed for the mixture with a mechanical grinder and a careful classification was carried out for them with an air classification machine, colored particles having a 50% volume particle diameter (Dv50) of 10.4 μm were obtained. For this colored particles, 1.2 mass % of hydrophobic silica (a degree of hydrophobilization=65/a number average primary particle diameter=12 nm) were added to obtain toner. This toner is referred as "Toner 8Bk".

"Toner 8Y" was obtained in the similar way in production of toner 8Bk with except that 8 parts of C.I. pigment yellow 185 was used instead of 10 parts of carbon black.

"Toner 8M" was obtained in the similar way in production of toner 8Bk with except that 10 parts of C.I. pigment red 122 was used instead of 10 parts of carbon black.

"Toner 8C" was obtained in the similar way in production of toner 8Bk with except that 5 parts of C.I. pigment blue 15:3 was used instead of 10 parts of carbon black.

The measurement results of the saturation water content (mass %) of the above-mentioned toners under 30° C., 80RH % ambient are shown in table 2.

Production of Developer

Each of above toners, that is, Toners 1Bk to Toner 8C (total 23 kids of toner) were mixed with ferrite carriers which were covered with silicone resin and had 50% volume particle diameter (Dv50) of 45 μm, whereby developer having a toner concentration of 6% was prepared respectively and used for evaluation. These 23 kids developers are referred as Developer 1Bk to Developer 8C corresponding to toner respectively.

The measurement of Dv50 of carriers can be performed typically by a laser diffraction type particle size distribution measuring apparatus HELOS, manufactured by Sympatec Co., Ltd., having a wet type dispersion device.

TABLE 1

| Toner No. | Toner prod. method No. | Water Content (Mass %) | 50% volume particle dia. (Dv50) (μm) | 50% number particle dia. (Dp50) (μm) | Dv50/ Dp50 | Cumulat. 75% volume particle dia. (Dv75) (μm) | Cumulat. 75% number particle dia. (Dp75) (μm) | Dv75/ Dp75 | Number % of particle less than 0.7 × Dp50 |
|---|---|---|---|---|---|---|---|---|---|
| 1-Bk | 1 | 0.2 | 3.8 | 3.6 | 1.05 | 3.4 | 3.2 | 1.06 | 6.5 |
| 2-Bk | 2 | 1.0 | 8.1 | 7.2 | 1.12 | 7.8 | 6.9 | 1.13 | 7.9 |
| 3-Bk | 3 | 1.8 | 5.8 | 5.6 | 1.03 | 5.4 | 5.1 | 1.06 | 7.1 |
| 4-Bk | 4 | 1.3 | 4.2 | 3.9 | 1.07 | 3.8 | 3.5 | 1.09 | 5.8 |
| 4-Y | 4 | 1.4 | 4.8 | 4.6 | 1.05 | 4.2 | 3.9 | 1.08 | 6.9 |
| 4-M | 4 | 1.5 | 4.3 | 4.2 | 1.03 | 4.0 | 3.8 | 1.06 | 5.9 |
| 4-C | 4 | 1.3 | 4.9 | 4.7 | 1.05 | 4.5 | 4.2 | 1.08 | 6.8 |

TABLE 1-continued

| Toner No. | Toner prod. method No. | Water Content (Mass %) | 50% volume particle dia. (Dv50) (μm) | 50% number particle dia. (Dp50) (μm) | Dv50/ Dp50 | Cumulat. 75% volume particle dia. (Dv75) (μm) | Cumulat. 75% number particle dia. (Dp75) (μm) | Dv75/ Dp75 | Number % of particle less than 0.7 × Dp50 |
|---|---|---|---|---|---|---|---|---|---|
| 5-Bk | 5 | 1.9 | 5.1 | 4.8 | 1.07 | 4.6 | 4.2 | 1.09 | 7.6 |
| 5-Y | 5 | 1.8 | 6.7 | 6.3 | 1.06 | 6.0 | 5.6 | 1.08 | 6.5 |
| 5-M | 5 | 1.8 | 5.9 | 5.5 | 1.08 | 5.5 | 5.0 | 1.09 | 6.7 |
| 5-C | 5 | 1.7 | 6.6 | 6.3 | 1.05 | 6.3 | 5.9 | 1.07 | 7.8 |
| 6-Bk | 6 | 1.9 | 9.5 | 8.4 | 1.13 | 9.1 | 8.0 | 1.14 | 8.1 |
| 6-Y | 6 | 1.8 | 10.3 | 9.6 | 1.08 | 10.0 | 9.0 | 1.11 | 7.8 |
| 6-M | 6 | 1.8 | 9.3 | 8.9 | 1.04 | 8.9 | 8.1 | 1.10 | 9.3 |
| 6-C | 6 | 1.7 | 9.9 | 8.8 | 1.13 | 9.6 | 7.8 | 1.23 | 8.1 |
| 7-Bk | 6 | 2.3 | 7.5 | 7.1 | 1.06 | 7.0 | 6.5 | 1.08 | 6.7 |
| 7-Y | 6 | 2.6 | 7.1 | 6.7 | 1.06 | 6.8 | 6.4 | 1.07 | 6.5 |
| 7-M | 6 | 2.3 | 6.5 | 6.2 | 1.05 | 6.0 | 5.7 | 1.06 | 6.8 |
| 7-C | 6 | 2.3 | 6.9 | 6.6 | 1.05 | 6.7 | 6.3 | 1.06 | 6.7 |
| 8-Bk | 6 | 2.3 | 10.4 | 9.2 | 1.13 | 10.0 | 8.7 | 1.15 | 10.3 |
| 8-Y | 6 | 2.6 | 9.9 | 8.5 | 1.16 | 9.2 | 7.6 | 1.21 | 9.6 |
| 8-M | 6 | 2.3 | 10.4 | 9.0 | 1.16 | 10.0 | 8.4 | 1.19 | 10.2 |
| 8-C | 6 | 2.3 | 10.3 | 8.7 | 1.18 | 10.0 | 8.3 | 1.21 | 9.7 |

Next, organic photoreceptors for use in Example were produced.

Manufacture of Organic Photoreceptor 1

<Intermediate Layer 1>

The cylinder type aluminum base support, which surface has 10 points surface roughness Rz of 0.81 μm measured according to regulation of JISB-0601 by subjecting to cutting process and washed, was subjected to coating with the following interlayer coating composition by dipping and thereafter drying, an interlayer having dry thickness of 3.0 μm was prepared.

The following intermediate layer dispersion liquid was diluted twice with the same mixed solvent, and filtered after settling for overnight (filter; Nihon Pall Ltd. company make RIGIMESH 5 μm filter, pressure 50 kPa), whereby the intermediate layer coating solution was produced.

(Preparation of Intermediate Layer Dispersion)

| | |
|---|---|
| Binder resin, exemplified Polyamide N-1) | 1 part (1.0 part by volume) |
| Anatase type titanium oxide A1 (number average primary particle diameter of 35 nm: subjected to surface treatment with titanium oxide in amount of 5 weight % of the total amount of the titanium oxide) by the use of a copolymer of methyl hydrogen polysiloxane and dimethylsiloxane (molar ratio = 1:1) | 3.5 parts (1.0 part by volume) |
| Ethanol/n-propylalcohol/THF (=45/20/30 by weight) | 10 parts |

The above-mentioned composites were mixed, dispersion was performed for 10 hours by a batch system, using a sand mill homogenizer, and whereby intermediate layer dispersion liquid was produced.

Charge Generating Layer

The following compositions were mixed and dispersed by use of a sand mill, whereby a charge generating layer coating liquid was prepared. This liquid was coated on the intermediate layer by means of an immersion coating method to form a charge generating layer having a dry layer thickness of 0.3 μm.

Charge generating material (G1): (Y type titanylphthalocyanine pigment having the maximum diffraction peak at 27.3° on Bragg angle (2θ±0.2°) in a Cu—Kα characteristic X-ray diffraction spectrum)

| | |
|---|---|
| Silicon modified polyvinyl butyral | 20 parts |
| 4-methoxy-4-methyl-2-pentanone | 10 parts |
| t-Butyl acetate | 700 parts |
| Charge transporting layer | 300 parts |

The following compositions were mixed and dissolved, whereby a charge transporting layer coating liquid was prepared. This coating liquid was coated on the above charge generating layer with an immersion coating method, whereby a charge transporting layer having a dried layer thickness of 25 μm was formed and Organic photoreceptor 1 was produced.

| | |
|---|---|
| Charge transporting material (CTM-4) | 70 parts |
| Binder resin (Exemplified compound BPZ (Mv:30000)) | 100 parts |
| Anti-oxidant (Exemplified compound 1-1) | 8 parts |
| Tetrahydrofuran/toluene (Volume ratio 8/2) | 750 parts |

Preparation of Organic Photoreceptors 2 Through 16

Organic photoreceptors 2 through 16 were prepared in the same manner as in Organic photoreceptor 1 except that the N-type semiconductor particles in the intermediate layer, binder resin and dried layer thickness, charge generating material, charge transporting material in the charge transporting layer, and a later thickness were changed as shown in Table 1. Here, an intermediate layer dispersion liquid was produced and an intermediate layer was formed in such a way that the total volume of the volume of binder resins and the volume of N-type semiconductor particles in all of the intermediate layers of Organic photoreceptors 1 to 15 were made constant and the volume ration (Vn/Vb) of the volume of binder resins and the volume of N-type semiconductor particles was changed. Here, Organic photoreceptor 16 was produced by eliminating N-type semiconductor particles from the intermediate layer of Organic photoreceptor 1.

Incidentally, at the same time with the production of Organic photoreceptors 1 to 16, each of the intermediate layer coating liquids was coated on an aluminum-deposited polyethylene terephthalate base support and then an intermediate layer having a dried layer thickness of 10 μm was formed on the same condition as the drying condition for the organic photoreceptors, whereby samples for a volume resistance measurement were prepared and the volume resistance of each intermediate layer was measured. As a result, the volume resistance of all of Organic photoreceptors 1 to 16 were $1\times10^8$ Ω·cm or more. The structural formula of the binder resin (BPZ) used for Organic photoreceptors 1 to 16 is shown below.

PC-Z(BPZ)

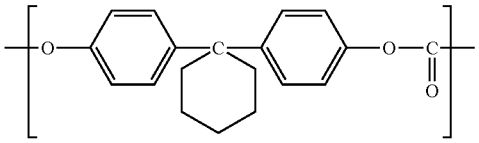

*4 is copolymer of ethylhydrogensiloxane and dimethylsiloxane whose molecular ratio of 1:1,

*5 is copolymer of methylhydrogensiloxane and methylethylsiloxane whose molecular ratio of 1:1, and

*6 is methylhydrogenpolysiloxane.

Incidentally, in Table 2, "surface treatment" is a substance used in the surface treatment applied for the surface of particles. (here, silica alumina in the primary treatment means silica alumina deposited on the particle surface).

The heat of fusion and the water absorbing degree were measured as follows:

Measurement of Heat of Fusion

Measuring apparatus: Shimadzu Flow Rate Differential Scanning Calorimeter DSC-50 manufactured by Shimadzu Corporation.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

TABLE 2

| | Intermediate layer | | | | | | | | | | | |
|---|---|---|---|---|---|---|---|---|---|---|---|---|
| | N-type semi-conductive particle and surface treatment | | | Binder resin | | | | | | | | |
| Photo receptor No. | Kind Of Particle | Number average primary dia. (nm) | Surface Treat. | Kind | Melt heat (J/g) | Water Content (Mass %) | Ratio of unit structure having carbon number of 7 or more (mol %) | Vol. ratio Vn/Vb | Layer thick (μm) | Charge Gen layer CGM | Charge trans layer CIM | Charge trans layer Layer thick (μm) |
| 1 | A1 | 35 | *1 | N-1 | 0 | 1.9 | 100 | 1.0 | 3.0 | G1 | CTM-4 | 25 |
| 2 | A1 | 35 | *2 | N-2 | 0 | 2 | 100 | 0.7 | 3.0 | G2 | CTM-12 | 25 |
| 3 | A1 | 35 | *3 | N-3 | 0 | 2.8 | 45 | 1.0 | 3.0 | G3 | CTM-14 | 25 |
| 4 | A2 | 35 | *4 | N-6 | 12 | 3.4 | 65 | 1.0 | 3.0 | G1 | CTM-4 | 25 |
| 5 | A2 | 35 | *5 | N-7 | 28 | 3.8 | 60 | 1.0 | 5.0 | G1 | CTM-4 | 25 |
| 6 | A1 | 35 | *6 | N-8 | 23 | 4.5 | 45 | 1.0 | 3.0 | G1 | CTM-4 | 25 |

In Table 1, G1, G2, and G3 represent the following charge generating materials respectively.

G1: Y type titanylphthalocyanine pigment having the maximum diffraction peak at 27.3° on Bragg angle (2θ±0.2°) in a Cu—Kα characteristic X-ray diffraction spectrum, G2: Hydroxy gallium phthalocyanine pigment having distinctive diffraction peak at at least 7.5°, 9.9°, 12.5°, 16.3°, 18.6°, 25.1°, 28.1° on Bragg angle (2θ+0.2°) in a Cu—Kα characteristic X-ray diffraction spectrum, and G3: Chloro gallium phthalocyanine pigment having distinctive diffraction peak at at least 7.4°, 16.6°, 25.5°, 28.3° on Bragg angle (2θ±0.2°) in a Cu—Kα characteristic X-ray diffraction spectrum.

A1 represents a rutile-type titanium oxide, and

A2 represents an anatase-type titanium oxide.

Z is a zinc oxide.

*1 is copolymer of methylhydrogensiloxane and dimethylsiloxane whose molecular ratio of 1:1,

*2 is copolymer of methylhydrogensiloxane and dimethylsiloxane whose molecular ratio of 9:1,

*3 is copolymer of methylhydrogensiloxane and dimethylsiloxane whose molecular ratio of 2:8, Measuring Condition of Water Absorption Degree The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

Evaluation 1 <by a Counter Developing Mode>

The obtained developers and organic photoreceptors were combined as shown in Table 3 (Combination No. 1-13), and mounted on a modified machine (a full color compound machine 8050 (process speed 220 mm/sec) of a tandem type using an intermediate transfer member is modified into a counter developing mode) of a commercial full color compound machine 8050 (made by Konica Minolta Camera Business Technologies), and a monochrome image evaluation using black toner was performed. A continuous copy was conducted on A4 size copy sheet with an original image having a white background portion, a solid image portion, a halftone image portion and a character image portion and copy images were evaluated. More concretely, at a starting time and each 5000$^{th}$ copy sheet, copy images to be evaluated was sampled and the total 300,000 copy sheets were evaluated. Evaluation items and evaluation criteria are indicated bellow.

As process conditions for a counter developing mode, Evaluation 1 was conducted by the use of the following conditions.

Peripheral speed of organic photoreceptor: 220 mm/sec

Magnetic brush bent depth (Bsd); 0.30 mm

Developing gap (Dsd); 0.28 mm

Alternate-current component of developing bias (Vac): 1.0 KVp-p

Peripheral speed ratio of a developing sleeve and a organic photoreceptor (Vs/Vopc): 2.0

Direct-current component of developing bias (Vdc): −500 V

Difference between the surface potential V0 of organic photoreceptor and the direct-current component Vdc of developing bias (|V0−Vdc|): 200 V Frequency: 5 kHz Duty ratio: 50% in a rectangular wave (1) Image Evaluation A Leading Section Image Density Lowering A halftone image was produced on a 300,000$^{th}$ copy sheet and evaluated.

AA: A leading section image density lowering was not observed and the halftone image was reproduced clearly. (very good)

A: Although the halftone image was reproduced clearly, there was a leading section image density lowering less than 0.04 in reflection density. (there is no problem for a practical)

C: There was a leading section image density lowering of 0.04 or more in reflection density on the halftone image. (there is a problem for a practical)

Fog

A fog density on a copy sheet at a starting time and a 300000$^{th}$ copy sheet were measured by the use of a densitometer "RD-918" (made by Macbeth Corp.) as a relative density in which a reflection density on a A4-size copy sheet was set to be 0.000 as to a fog density.

AA: less than 0.010 (very good)

A: 0.010 to 0.020 (a level with which there is no problem for a practical use)

C: 0.020 or more (there is a problem for a practical)

Image Density

An image density on a copy sheet at a starting time and a 30,000$^{th}$ copy sheet were measured by the use of a densitometer "RD-918" (made by Macbeth Corp.) as a relative density in which an image density on a printer copy sheet was set to be 0.0.

AA: 1.3 or more/very good

A: 1.0 to 1.3/a level with which there is no problem for a practical use

C: less than 1.0/there is a problem for a practical use

Results are shown in Table 3.

TABLE 3

| | | | Image evaluation | | | |
|---|---|---|---|---|---|---|
| Comb. No. | Deve. No. | Photo. No. | Image density | Fog | Leading Edge Density lowering | |
| 1 | 1-Bk | 1 | AA | AA | A | Inv. |
| 2 | 2-Bk | 1 | AA | AA | A | Inv. |
| 3 | 3-Bk | 1 | AA | AA | A | Inv. |
| 4 | 4-Bk | 1 | AA | A | A | Inv. |
| 5 | 5-Bk | 1 | AA | A | A | Inv. |
| 6 | 1-Bk | 2 | AA | A | A | Inv. |
| 7 | 2-Bk | 3 | AA | A | A | Inv. |
| 8 | 3-Bk | 4 | AA | AA | A | Inv. |
| 9 | 4-Bk | 5 | AA | A | AA | Inv. |
| 10 | 5-Bk | 6 | AA | A | A | Inv. |
| 11 | 6-Bk | 1 | A | C | C | Comp. |
| 12 | 7-Bk | 1 | C | A | C | Comp. |
| 13 | 8-Bk | 1 | C | C | C | Comp. |

As can be seen from Table 3, in the image evaluation obtained by the counter developing mode, when 50% number particle diameter is represented by Dp50, in Combination Nos. 1-10 in which toner contained toner particles having a particle diameter of 0.7×(Dp50) or less by 8 number % or less and had water content of 0.1 to 2.0 mass % (under an environment of 30° C. and 80% RH), all evaluation items of the image density, the fog and the leading section image density lowering showed good characteristics. In contrast, in Combination 11 in which toner contained toner particles having a particle diameter of 0.7×(Dp50) or less by more than 8 number %, the fog and the leading section image density lowering occurred. Also, in Combination 12 in which toner had water content larger than 2.0, the image density lowered and the leading section image density lowering occurred. In addition, in Combination 13 in which toner contained toner particles having a particle diameter of 0.7×(Dp50) or less by more than 8 number % and had water content larger than 2.0, the image density lowered, the fog was generated and the leading section image density lowering occurred.

Evaluation 2<Evaluation by a Parallel Developing Mode>

The evaluation conducted in Evaluation 1 was conducted with a parallel developing mode in which the moving direction of the organic photoreceptor was parallel to that of the developing sleeve.

Evaluation Condition

Peripheral speed of organic photoreceptor: 220 mm/sec

Peripheral speed of a developing sleeve: 440 mm/sec

As a result, the difference like that between the inventive example and the comparative example in Evaluation 1 was not clearly observed, and in comparison with the counter development mode in Evaluation 1 of the present invention, the image density lowered and the electro-photography picture image of a insufficient image density was obtained.

Evaluation 3

The developers and organic photoreceptors were combined as shown in Table 4 (Combination No. 21-25), and mounted on a modified machine (a full color compound machine 8050 (process speed 220 mm/sec) of a tandem type using an intermediate transfer member is modified into a counter developing mode and the following process conditions) of a commercial full color compound machine 8050 (made by Konica Minolta Camera Business Technologies), and a full color image evaluation was performed. A continuous copy was conducted on A4 size copy sheet with an original image having a white background portion, a solid image portion, a halftone image portion and a character image portion and copy images were evaluated. More concretely, at a starting time and each $5000^{th}$ copy sheet, copy images to be evaluated was sampled and the total 300,000 copy sheets were evaluated. As evaluation items, color reproducibility and worm-like unevenness were added in addition to the evaluation items conducted in Evaluation 1.

As the process conditions for a counter developing mode, Evaluation 4 was conducted by the use of the following conditions.

Peripheral speed of organic photoreceptor: 220 mm/sec

Magnetic brush bent depth (Bsd); 0.50 mm

Developing gap (Dsd); 0.38 mm

Alternate-current component of developing bias (Vac): 1.2 KVp-p

Peripheral speed ratio of a developing sleeve and a organic photoreceptor (Vs/Vopc): 2.3

Direct-current component of developing bias (Vdc): −500 V

Difference between the surface potential V0 of organic photoreceptor and the direct-current component Vdc of developing bias (|V0−Vdc|): 200 V Frequency: 5 kHz Duty ratio: 50% in a rectangular wave (2) Image Evaluation Color Reproducibility Color on solid image portions of secondary color (red, blue and green) in each toner image of Y, M, and C on images of a first printed sheet and a $100^{th}$ printed sheet by the use of "MacbethColor-Eye7000" and the color difference of the solid image on the first printed sheet and the $100^{th}$ printed sheet was calculated by the use of a CMC (2:1) color difference formula.

AA: The color difference was smaller than 3 (excellent)

C: The color difference was larger than 3 (it was problematic practically and a practical use was not permissible)

Worm-like Unevenness

The presence or absence of worm-like unevenness was observed and evaluated by checking a halftone picture image on a $10,000^{th}$ printed sheet with a magnifying glass (×20).

AA: Occurrence of unevenness was not observed.

A: Unevenness was observed slightly, but there was no problem.

C: There was unevenness which was observed in a form of wavelike unevenness and it was problem for a practical use.

Results are shown in Table 4.

TABLE 4

| | | | Image evaluation | | | | |
|---|---|---|---|---|---|---|---|
| Comb. No. | Toner No. | Photo. No. | Image density | Fog | Leading edge density lowering | Color Reproducibility | Worm Like Unevenness |
| 21 | 4Bk - 4C | 1 | AA | AA | AA | AA | AA |
| 22 | 5Bk - 5C | 1 | AA | AA | AA | AA | AA |
| 23 | 6Bk - 6C | 1 | A | C | C | C | C |
| 24 | 7Bk - 7C | 1 | C | A | C | C | A |
| 25 | 8Bk - 8C | 1 | C | C | C | C | C |

As can be seen from Table 4, in the image evaluation obtained by the counter developing mode, in Combination Nos. 21, and 22 in which toner contained toner particles having a particle diameter of 0.07×(DP50) or less by 8 number % or less and had water content of 0.1 to 2.0 mass % (under an environment of 30° C. and 80% RH), all evaluation items of the image density, the fog, the leading section image density lowering and the worm-like unevenness showed good characteristics as well as the color reproducibility showed good characteristics. In contrast, in Combination 23 in which toner contained toner particles having a particle diameter of 0.7×(Dp50) or less by more than 8 number %, the fog and the leading section image density lowering occurred and the color reproducibility and the worm-like unevenness deteriorated. In Combination 24 in which toner had water content larger than 2.0, the image density lowered and the leading section image density lowering occurred and the color reproducibility deteriorated. In addition, in Combination 25 in which toner contained toner particles having a particle diameter of 0.7×(Dp50) or less by more then 8 number % and had water content larger than 2.0, the image density lowered, the fog was generated and the leading section image density lowering occurred and the color reproducibility and the worm-like unevenness deteriorated.

What is claimed is:

1. An image forming method, comprising the steps of:

forming an electrostatic latent image on an organic photoreceptor rotating in a rotating direction;

forming a magnetic brush with a developing agent containing a toner and a carrier on a rotatable developing sleeve; and visualizing the electrostatic latent image into a toner image by bringing the magnetic brush in contact with the organic photoreceptor at a developing section while the developing sleeve is rotated in a direction counter to the rotating direction of the organic photoreceptor at the developing section;

wherein the toner contains toner particles having a particle diameter of 0.7×(Dp50) or less in an amount of 8 number % or less and has a water content of 0.1 to 2.0 mass % under an environment of 30° C. and 80% RH, where Dp50 represents 50% number particle diameter of the toner particles in a number distribution, and the carrier is a resin-coated carrier composed of magnetic particles which have a 50% volume particle diameter of 15 to 100 μm and are covered with resin, wherein the organic photoreceptor comprises a conductive support, an intermediate layer including 100 to 200 parts by volume of N-type semiconductor particles having a number average primary particle diameter of 3 to 200 nm to 100 parts by volume of binder resin, a charge generating layer including 20 to 600 weight parts of a charge generating material to 100 weight parts of a binder resin, and a charge transporting layer including 50 to 200 weight parts of a charge transporting material to 100 weight parts of binder resin, and wherein the visualizing step is conducted on the conditions that a developing gap (Dsd) between the organic photoreceptor and the developing sleeve is 0.2 to 0.6 mm; a bent depth (Bsd) of the magnetic brush at the developing section is 0 to 0.8 mm, where the bent depth (Bsd)=the height (h) of the magnetic brush−the developing gap (DSD); a peripheral speed ratio (Vs/Vopc) of the developing sleeve and the organic photoreceptor is 1.2 to 3.0; and a developing bias includes a direct-current component Vdc of −300 to −650 V and an alternate current component Vac of 0.5 to 1.5 KV.

2. The image forming method of claim 1, wherein in the toner, a ratio (Dv50/Dp50) of 50% volume particle diameter (Dv50) to 50% number particle diameter (Dp50) is 1.0 to 1.11, a ratio (Dv75/Dp75) of cumulative 75% volume particle diameter (Dv75) calculated from the largest volume particle diameter to cumulative 75% number particle diameter (Dp75) calculated from the largest number particle diameter is 1.0 to 1.10.

3. The image forming method of claim 2, wherein the 50% volume particle diameter (Dv50) is 2 to 9 μm.

4. The image forming method of claim 1, wherein the N-type semiconductive particles comprise particles of titanium oxide or zinc oxide.

5. The image forming method of claim 1, wherein the N-type semiconductive particles comprise particles of titanium oxide.

6. The image forming method of claim 5, wherein the titanium oxide is a rutile type titanium oxide pigment or an anatase type titanium oxide pigment.

7. The image forming method of claim 1, wherein the peripheral speed ratio (Vs/Vopc) of the developing sleeve and the organic photoreceptor is 1.5 to 2.5.

8. The image forming method of claim 1, wherein a difference |Vo−Vdc| between a surface electric potential Vo of the organic photoreceptor and the direct-current component Vdc of the developing bias is 100 to 300 V, the frequency of the alternate current component is 3 to 9 KHz, a duty ratio is made 45 to 70% (the time ratio of the developing side in a rectangular wave), and the shape of the alternate current component is a rectangular wave.

9. An image forming method, comprising the steps of:

(a) conducting the image forming method described in claim 1 to form a toner image on the organic photoreceptor;

(b) transferring the toner image from the organic photoreceptor to an intermediate transfer member;

(c) conducting the steps of (a) through (b) for each of a plurality of different colored toners the plurality of different colored toners being a yellow toner, a magenta toner, a cyan toner, and a black toner, so as to superimpose a plurality of different color toner images successively in a particular order, namely, yellow first, magenta second, cyan third and black last, on the intermediate transfer member; and (d) transferring the superimposed different color toner images onto a recording material.

10. An image forming method, comprising the steps of:

conducting the image forming method described in claim 1 for each of a plurality of different colored toners the plurality of different colored toners being a yellow toner, a magenta toner, a cyan toner, and a black toner, for respective organic photoreceptors so as to form different colored toner images on the respective organic photoreceptors;

transferring the plurality of different colored toner images from the respective organic photoreceptors successively in a particular order, namely, yellow first, magenta second, cyan third and black last, to an intermediate transfer member so as to superimpose the different colored toner images on the intermediate transfer member; and transferring the superimposed different color toner images onto a recording material.

* * * * *